US007770345B2

(12) United States Patent
McConnell et al.

(10) Patent No.: US 7,770,345 B2
(45) Date of Patent: Aug. 10, 2010

(54) FLOOR TILE WITH ADHESIVELY JOINED CONCRETE SUB-BLOCKS

(75) Inventors: Anthony McConnell, Zeeland, MI (US); Ronald H. Brown, Holland, MI (US); Bryan R. Gingrich, Holland, MI (US); Robert L. Tuttle, Holland, MI (US); Randolph Woellper, Hudsonville, MI (US); X. Shawn Yu, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 55 days.

(21) Appl. No.: 11/998,918

(22) Filed: Dec. 3, 2007

(65) Prior Publication Data

US 2009/0084046 A1 Apr. 2, 2009

Related U.S. Application Data

(60) Provisional application No. 60/997,023, filed on Sep. 28, 2007.

(51) Int. Cl.
*E04B 5/00* (2006.01)
*E04B 9/00* (2006.01)
*E04C 2/34* (2006.01)

(52) U.S. Cl. ..... 52/263; 52/126.6; 52/792.1

(58) Field of Classification Search ..... 52/126.6, 52/263, 792.1
See application file for complete search history.

(56) References Cited

U.S. PATENT DOCUMENTS

| | | | | |
|---|---|---|---|---|
| 3,271,917 | A | | 9/1966 | Rubenstein |
| 4,035,967 | A | | 7/1977 | Harvey |
| 4,085,557 | A | | 4/1978 | Tharp |
| 4,390,580 | A | | 6/1983 | Donovan |
| 4,447,998 | A | | 5/1984 | Griffin |
| 4,621,468 | A | * | 11/1986 | Likozar ..... 52/126.6 |
| 4,719,727 | A | * | 1/1988 | Cooper et al. ..... 52/126.6 |
| 4,729,859 | A | | 3/1988 | Munsey |
| 4,850,176 | A | * | 7/1989 | Munsey et al. ..... 52/802.1 |
| 4,914,881 | A | | 4/1990 | Spork |
| 4,922,670 | A | * | 5/1990 | Naka et al. ..... 52/126.6 |
| 4,944,130 | A | * | 7/1990 | Pallhorn ..... 52/792.1 |
| 4,996,804 | A | | 3/1991 | Naka |
| 5,048,242 | A | * | 9/1991 | Cline ..... 52/126.6 |
| 5,057,355 | A | * | 10/1991 | Klingelhofer et al. ..... 428/192 |
| 5,088,251 | A | | 2/1992 | Hazeldine |
| 5,111,627 | A | | 5/1992 | Brown |
| 5,111,630 | A | * | 5/1992 | Munsey et al. ..... 52/508 |

(Continued)

FOREIGN PATENT DOCUMENTS

| | | |
|---|---|---|
| EP | 0 225 090 | 6/1987 |

(Continued)

*Primary Examiner*—Richard E Chilcot, Jr.
*Assistant Examiner*—Andrew J Triggs
(74) *Attorney, Agent, or Firm*—Flynn, Thiel, Boutell & Tanis, P.C.

(57) ABSTRACT

A floor tile for a raised floor. The floor tile is defined by a shallow upwardly-opening metal pan defining a shallow compartment in which a main preformed one-piece concrete block is secured. The main concrete block is preferably formed from a plurality of one-piece preformed concrete sub-blocks which are adhesively adhered in sideward abutting relationship to define a plan profile corresponding to the main concrete block. The main concrete block is then adhesively secured within the compartment of the metal pan.

17 Claims, 25 Drawing Sheets

U.S. PATENT DOCUMENTS

| | | | | |
|---|---|---|---|---|
| 5,333,423 | A | 8/1994 | Propst | |
| 5,398,466 | A | 3/1995 | Oyama | |
| 5,904,009 | A | 5/1999 | Huang | |
| 6,202,374 | B1 * | 3/2001 | Cooper et al. | 52/220.3 |
| 6,418,697 | B1 * | 7/2002 | Da Molin | 52/792.11 |
| 6,550,195 | B1 * | 4/2003 | Cooper et al. | 52/220.3 |
| 6,818,275 | B2 * | 11/2004 | Guarda et al. | 428/119 |
| 6,880,303 | B2 * | 4/2005 | Mead | 52/263 |
| 6,911,248 | B2 * | 6/2005 | Sabatini | 428/119 |
| 6,918,217 | B2 * | 7/2005 | Jakob-Bamberg et al. | 52/263 |
| 6,983,570 | B2 * | 1/2006 | Mead | 52/263 |
| 7,509,782 | B2 * | 3/2009 | Colosimo et al. | 52/792.1 |
| 2002/0062625 | A1 * | 5/2002 | Foden | 52/783.1 |
| 2003/0033767 | A1 * | 2/2003 | Mead | 52/263 |
| 2003/0033768 | A1 * | 2/2003 | Cikesh | 52/263 |
| 2003/0051420 | A1 * | 3/2003 | Leon | 52/126.6 |
| 2003/0097808 | A1 * | 5/2003 | Sabatini | 52/384 |
| 2003/0177723 | A1 * | 9/2003 | Jakob-Bamberg et al. | 52/263 |
| 2005/0005547 | A1 * | 1/2005 | Mead | 52/263 |
| 2005/0193660 | A1 * | 9/2005 | Mead | 52/263 |
| 2005/0235589 | A1 * | 10/2005 | Jakob-Bamberg et al. | 52/263 |
| 2006/0144005 | A1 | 7/2006 | Tonyan | |
| 2008/0141601 | A1 * | 6/2008 | Mead | 52/263 |
| 2009/0084046 | A1 * | 4/2009 | McConnell et al. | 52/126.6 |
| 2009/0084066 | A1 * | 4/2009 | Brown et al. | 52/745.19 |

FOREIGN PATENT DOCUMENTS

| | | | |
|---|---|---|---|
| EP | 0 295 417 | | 12/1988 |
| EP | 1 304 425 | A1 | 4/2003 |
| EP | 1 329 568 | A1 | 7/2003 |
| WO | WO 02/099222 | A1 | 12/2002 |

* cited by examiner

FLOOR TILE WITH ADHESIVELY JOINED CONCRETE SUB-BLOCKS

CROSS REFERENCE TO RELATED APPLICATION

This application claims the benefit of U.S. Provisional Application No. 60/997,023, filed Sep. 28, 2007, the disclosure of which is incorporated herein by reference in its entirety.

FIELD OF THE INVENTION

This invention relates to improvements with respect to a raised floor system, including improvements relative to floor tiles and the supports therefor, and improvements relative to the manufacturing process for the floor tiles.

BACKGROUND OF THE INVENTION

A significant variety of raised floor systems have been developed for use in commercial buildings. Such systems typically employ a plurality of height-adjustable pedestals supported on a main floor in a grid-like arrangement, and a plurality of removable floor tiles supported on the upper ends of the pedestals. The floor tiles are formed using numerous construction techniques, with one common technique employing a formed sheet metal pan defining an upwardly opening compartment which is filled with concrete. The space below the raised floor is utilized for accommodating cabling such as power, data and communication cabling, and in addition accommodates or defines ducts for heating, ventilating and air conditioning (HVAC).

In known floor systems employing composite steel and concrete floor tiles, which tiles in plan view are typically relatively large squares having side dimensions of about 24 inches, the tiles due to their construction and size are necessarily both bulky and heavy so that transport of such tiles over long distances is undesirably costly. Also, since the tiles are normally formed utilizing at least partially automated machinery capable of filling, leveling, curing and finishing the concrete, this normally mandates that the tiles be produced in rather large quantities at a centralized manufacturing location. Further, filling the metal pans with wet concrete and achieving a proper structural interconnection of the hardened concrete to the metal pan so as to provide the finished floor tile, when in use, with the necessary strength and durability, has presented an ongoing problem.

In a continuing development effort to improve the strength and durability of the floor tiles and specifically the structural connection of the concrete to the metal pan, the metal pan is typically provided with protrusions or barbs, particularly associated with the horizontal bottom wall of the pan, which protrude upwardly into the concrete poured into the pan in an effort to increase structural strength and structural interconnection of the concrete to the pan. While these techniques have proven to improve the strength characteristics, these techniques also increase the complexities associated both with the manufacture of the pan and the forming of the concrete therein.

In addition to the above, floor tiles of the type utilizing a wet concrete mix poured into a metal pan also typically utilize gypsum cement to create the wet concrete mix. This, however, creates additional disadvantages due not only to the expense of gypsum cement, but also due to its characteristics. Specifically, concrete mix formed using gypsum cement experiences dimensional instability in that the concrete dimensionally changes, specifically grows, during drying or curing. This hence creates significant dimensional instability with respect to the finished floor tile, and requires significant grinding or surface finishing of the exposed upper surface of the concrete in order to achieve the desired finished dimension of the floor tile. In addition, since wet concrete mix formed using gypsum cement requires utilization of a significant quantity of water, this reduces the strength properties of the concrete. Nevertheless, gypsum cement is typically utilized since curing of the concrete can be accomplished over a shorter number of days, typically three to four days, in contrast to the longer curing time of Portland cement, typically about seven days. Even so, this technique of forming floor tiles by depositing wet concrete mix into preformed metal pans is undesirable with respect to the time and space requirements demanded for production of such floor tiles, and hence this technique is limited to situations where these restrictions and the limitations imposed on the volume of production can be tolerated.

As an alternative to the manufacturing technique wherein wet concrete is poured into and cured within a metal pan, and the disadvantages associated with such technique, other floor tiles have been manufactured wherein a preformed block, frequently of wood, is positioned within a metal pan and secured therein, and is typically wholly enclosed within the pan by means of a separate covering or top walls. Such constructions, however, typically lack the strength and durability achieved utilizing floor tiles formed dominantly of concrete.

While attempts have been made to design and develop floor tiles employing a concrete block positioned within a metal pan by preforming the concrete and then forming the pan therearound, such as by shaping or bending the pan around a preformed block, such technique is also undesirable in terms of its processing limitations and the difficulty in achieving desired dimensional tolerances.

Examples of known constructions of raised floor arrangements, and specifically the floor tiles and pedestals associated therewith, are illustrated by U.S. Pat. Nos. 4,085,557, 4,621,468, 4,719,727, 4,914,881, 4,944,130, 5,057,355, 5,088,251, 5,333,423, 5,904,009, 6,418,697, 6,918,217 and 2003/0097808 A1.

Accordingly, it is an object of this invention to provide an improved raised floor system and more specifically an improved floor tile for such system, which floor tile specifically involves a composite construction wherein a concrete core or block is confined within a formed metal pan, with the construction of the floor tile providing structural fixation of the concrete to the metal pan so as to provide significantly improved structural characteristics and integrity, while at the same time permitting the forming and utilization of a metal pan which is free of protrusions or the like which complicate the construction and configuration of the pan.

It is also an object of the present invention to provide an improved manufacturing process for the floor tile, specifically with respect to the manner in which the concrete and metal pan are formed and secured together.

It is a further object of the invention to provide an improved floor tile for a raised floor system whereby the tile, employing a preformed concrete block positioned in and adhered to a preformed metal pan, provides improvements with respect to strength of the resultant floor tile and at the same time permits the floor tile to be manufactured with less process time, while at the same time avoiding the undesired material variations, environmental variations and process control issues typically encountered when forming floor tiles using a wet concrete mix poured into the pan.

It is a still further object of the invention to provide an improved floor tile, as aforesaid, which avoids the manufacturing cycle limitations, namely time limitations, associated with conventional manufacturing processes which involve pouring wet concrete mix into preformed metal pans.

It is another object of the invention to provide an improved floor tile having a simplified mechanical design which results in simplification of the manufacturing process, which provides an improved installed uncovered appearance, and which permits the use of industry-standard concrete finishing, sealing and polishing techniques.

Still another object of the invention is to provide an improved floor tile for a raised floor, and the process of making the floor tile, wherein the concrete mix which is utilized for defining the block is effectively a dry mix, that is, a mix of concrete and aggregate which utilizes minimal water so as to permit forming and curing of the concrete block as a preform in a minimal period of time, with the preform thereafter being positioned in and adhesively adhered to the preformed metal pan.

A still further object of the invention is to provide a floor tile and forming process, as aforesaid, which utilizes Portland cement for the dry concrete mix to achieve reduced material cost and material stability during drying or curing, with the overall curing time being significantly reduced by forming of the preformed concrete blocks from the dry concrete mix.

It is a further object of the invention to provide an improved raised floor system having improvements associated with the pedestal construction which supports the floor tiles in raised relationship relative to a main floor, which improved pedestal construction simplifies the connection of the floor tiles to the pedestals while providing a desirable finished appearance with respect to the visible upper surface of the raised floor.

Other objects and purposes of the invention will be apparent upon reading the following specification and inspecting the accompanying drawings.

SUMMARY OF THE INVENTION

In accordance with a preferred construction and manufacturing process for a floor tile according to the present invention, the floor tile is primarily of a two-piece construction defined by a shallow upwardly-opening metal pan defining a shallow compartment therein in which a main preformed one-piece concrete block is stationarily secured. The metal pan has upwardly protruding side walls formed with top hems or flanges which protrude downwardly over the exterior surfaces thereof. The corners of the pan are provided with slits which protrude downwardly from upper edges of the side walls, whereby the side walls can be resiliently angularly deflected outwardly upon application of a force thereto. The main preformed concrete block is preferably formed from a plurality (preferably three) of one-piece preformed concrete sub-blocks which are preferably identical, with a predetermined number of sub-blocks being positioned in sideward abutting relationship to define a plan profile corresponding to the main concrete block. One or both opposed side edges of the sub-blocks are coated with an adhesive, such as a hot melt, and are then pressed and held in abutting contact so as to fixedly and rigidly join the sub-blocks together to create the main one-piece concrete block. The main concrete block is then adhesively secured within the compartment of the metal pan, with the latter preferably being accomplished by coating the bottom surface of the main concrete block with adhesive, and by coating the inner surfaces of the pan side walls with adhesive. The pan side walls are deflected outwardly to permit proper disposition of the main concrete block within the compartment of the pan and allow the pan and concrete block to be pressed together to create a secure fixed bonded relationship between the main concrete block and the bottom wall of the pan. The side walls of the pan are also deflected inwardly so as to press against and adhesively and fixedly secure to the side or edge faces of the main concrete block. The resulting floor tile can then have the exposed upper surface of the concrete block treated as appropriate, such as by grinding the upper surface to provide a desired smoothness and appearance, with the floor tile then being suitable for use as part of a raised floor system.

As an alternative construction and forming process for the floor tile, the metal floor pan can have the shallow upwardly-opening compartment thereof filled with wet concrete. Prior to pouring of the wet concrete into the pan, however, the interior surfaces of the bottom and side walls of the pan are coated with a suitable adhesive, such as a hot melt. The adhesive coating as applied to at least the bottom wall of the pan is also then provided with a layer of fine-grained sand sprinkled thereover, which sand is effectively wetted and embedded into the adhesive layer. A wet concrete mix, which also has an adhesive mixed therein, is then poured into the pan so as to fill the compartment. The adhesive in the concrete readily cooperates with the sand layer and adhesive pre-applied to the pan to create a highly effective and strong securement of the concrete to the pan as the concrete hardens and cures within the pan. As an alternative to the above, rather than including adhesive within the wet concrete mix, a second layer of adhesive can be sprayed into the pan after the sand layer has been applied, following which the wet concrete can be poured into the pan and allowed to cure and harden while the adhesive arrangement creates a secure and strong fixed securement of the hardened concrete core to the metal pan.

The raised floor system of the invention incorporates a grid of height-adjustable pedestals which individually provide a top support plate to function as a support for engagement with corner portions of four adjacent floor tiles. This top support plate has upwardly-protruding positioning elements which are adapted to project into small gaps defined between sidewardly adjacent floor tiles for ensuring proper positioning of the tiles with respect to one another and with respect to the pedestal. A fastener such as an elongate screw projects vertically downwardly adjacent the corner of the floor tiles for threaded engagement with the pedestal arrangement. The fastener cooperates with a hold-down member, such as an annular washer which in turn cooperates with corners of the floor tiles to effect fixing of the floor tiles relative to the pedestal head when the fastener is tightened.

Figure 1:
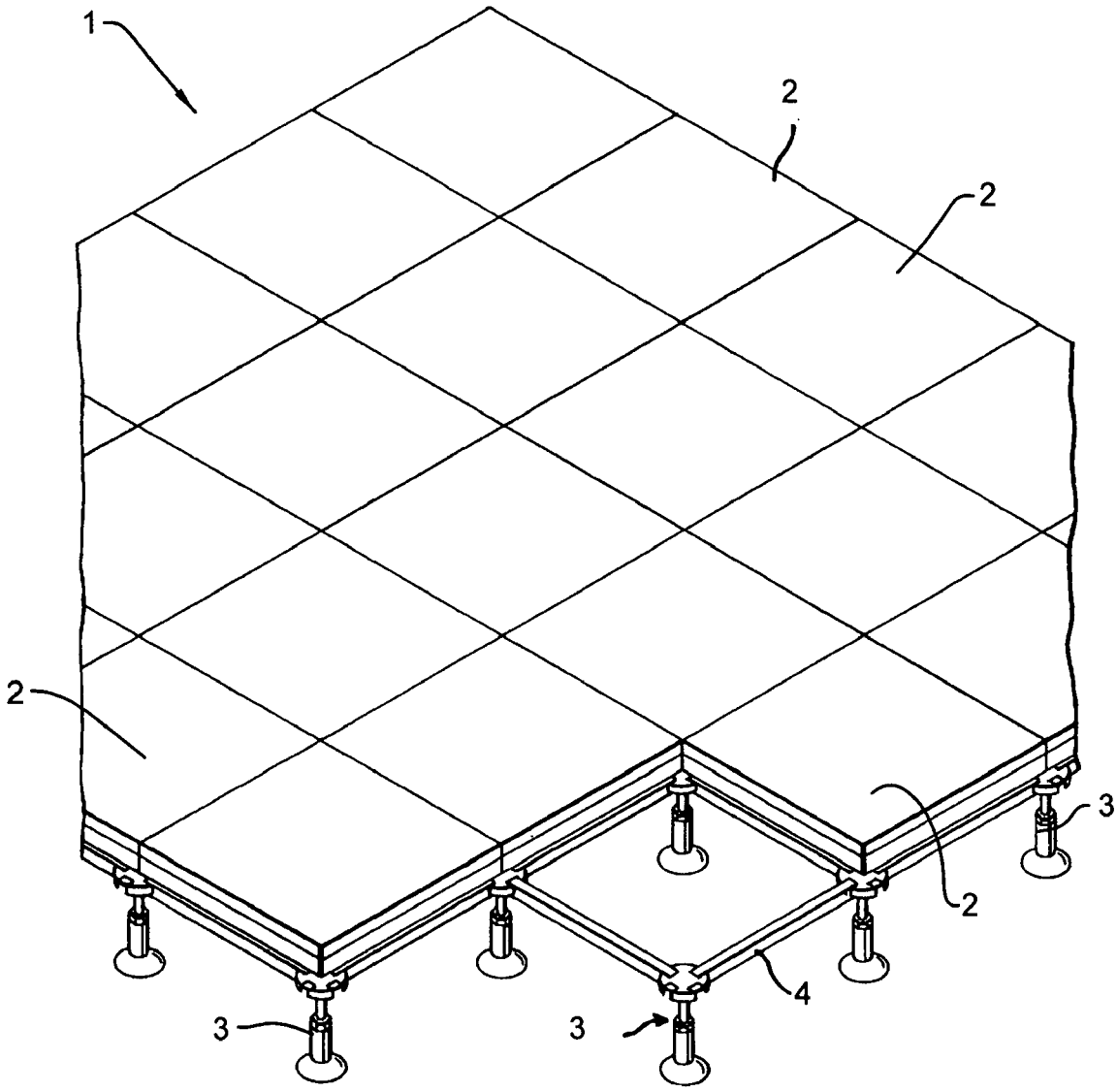
FIG. 1 (PRIOR ART)
FIG. 1 is a fragmentary perspective view illustrative of a conventional raised floor system.
Figure 2:
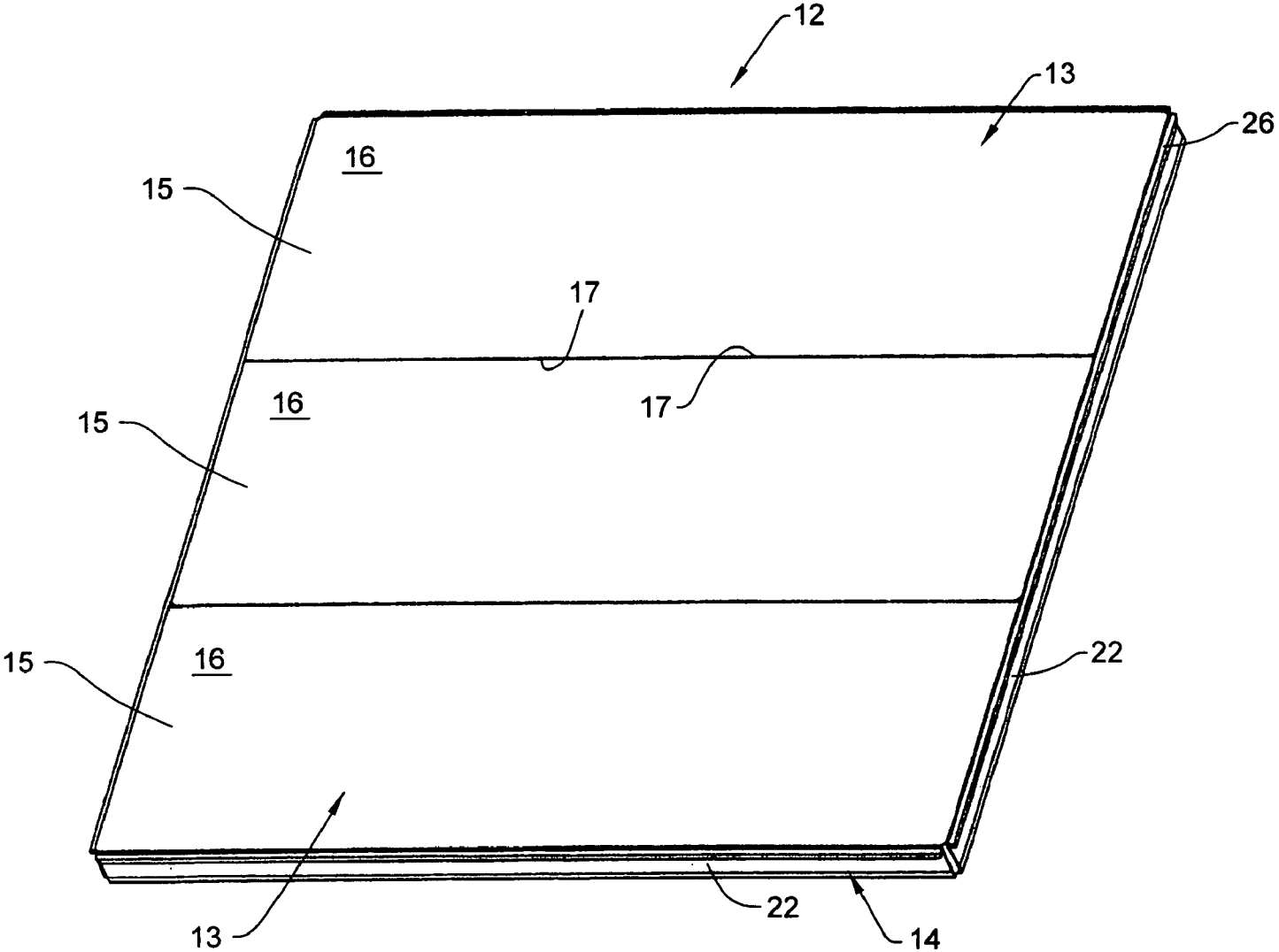
FIG. 2 is a perspective view of an improved floor tile for a raised floor in accordance with the present invention.
Figure 3:
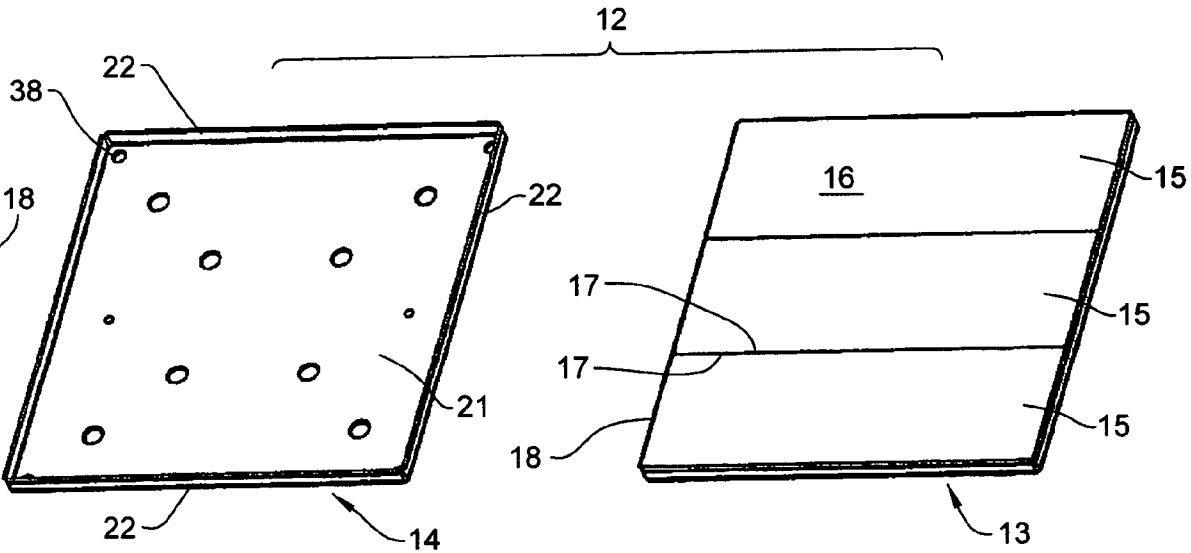
FIG. 3 is an exploded perspective view of the floor tile illustrated in FIG. 2.

Certain terminology will be used in the following description for convenience and reference only, and will not be limiting. For example, the words "upwardly", "downwardly", "rightwardly" and "leftwardly" will refer to directions in the drawings to which reference is made. The words "upwardly" and "downwardly" will also refer to directions associated with the floor when installed over a subfloor. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, there is illustrated a somewhat conventional raised floor arrangement 1 defined by a plurality of generally square removable floor tiles 2, the latter being supported on a plurality of upright pedestals 3 which are typically arranged in uniformly spaced relationship within rows and columns to define a grid, whereby each pedestal typically cooperates with the corners of up to four floor tiles. The arrangement of FIG. 1 also illustrates horizontally elongate stringers or rails 4 extending between and joined to adjacent pedestals 3, which stringers are frequently utilized to provide supportive engagement for the edge of the floor tiles, although in many systems the stringers are eliminated and the floor tiles are supported entirely by the pedestals. The conventional arrangement of a raised floor as diagrammatically depicted by FIG. 1 is solely for background purposes, and it will be understood that the improved floor system of the present invention as described hereinafter includes similar cooperative relationships when assembled to define a raised floor.

Referring now to FIGS. 2-11, there is illustrated a preferred embodiment of a floor tile 12 constructed in accordance with the present invention for use in defining a raised floor. The floor tile 12 is primarily of a metal and concrete composite construction, and is defined principally by a main one-piece concrete block or core 13 confined within a shallow upwardly-opening box-shaped metal pan 14.

The main one-piece concrete block 13 is a preform created from a plurality of one-piece preformed concrete sub-blocks 15. The sub-blocks 15 are preferably of identical configuration, and a predetermined number of sub-blocks 15, three in the illustrated and preferred embodiment, are disposed in a configuration (i.e. a square) to define the outer plan-view profile of the main block 13, and are then fixedly joined together as by adhesively securing the opposed abutting edge faces 17 so that the plurality of sub-blocks 15 define a rigid one-piece construction.

Figure 4:
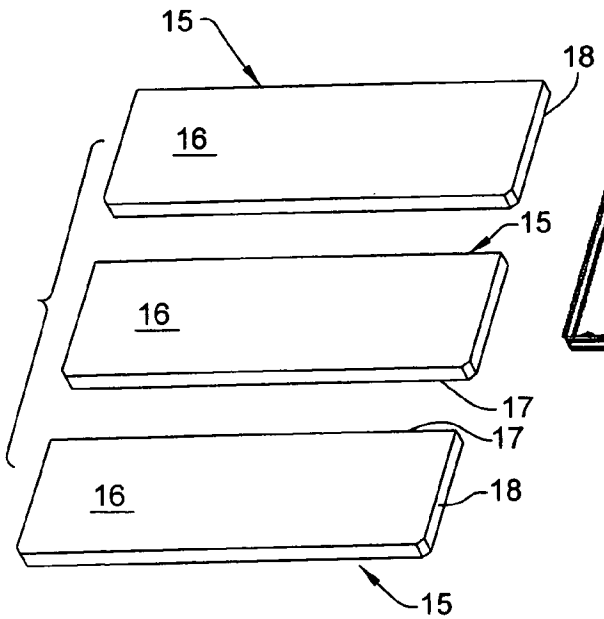
FIG. 4 is an exploded perspective view illustrating the preformed sub-blocks utilized for forming the preformed main block utilized in the tile of FIG. 3.
Figure 9:
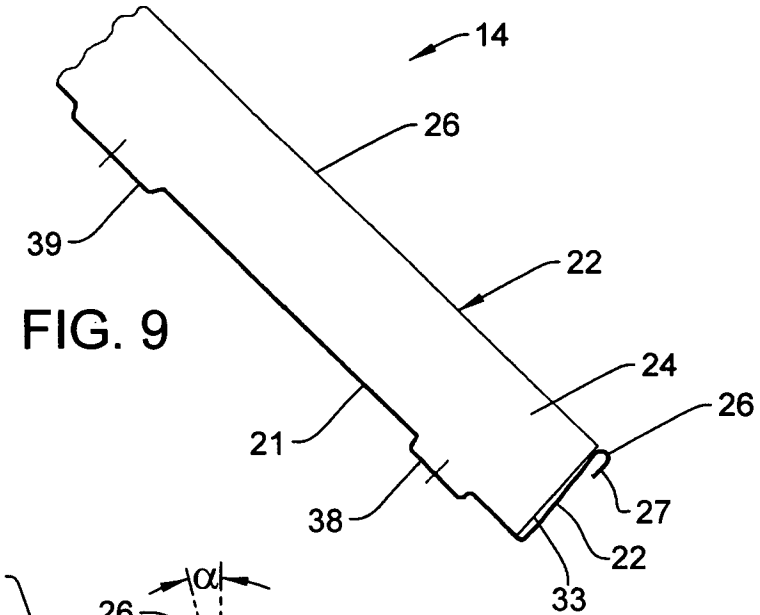
FIG. 9 is an enlarged fragmentary sectional view taken generally along line 9-9 in FIG. 5.

As illustrated by FIG. 4, in the preferred construction the three identical preformed sub-blocks 15 are each of generally rectangular configuration in plan view, and are disposed in side-by-side relationship so that the opposed elongate side faces 17 are in directly opposed relationship. A suitable adhesive such as a conventional hot melt is applied to one or both opposed side faces 17 of the concrete sub-blocks 15, whereupon the three sub-blocks 15 are then moved horizontally into sidewardly abutting and contacting relationship to define a generally square profile. The sub-blocks 15 are appropriately held in pressed together relationship for a sufficient period of time to enable the adhesive between the contacting faces 17 to solidify and create a rigid securement of the three sub-blocks 15 together to hence define the one-piece preformed main block 12. As thus created, the main block 12 has the desired configuration, namely a square plan profile, with the block 12 having generally flat and parallel top and bottom faces 16 and 19, respectively.

The one-piece preformed concrete main block 12 is adapted to be positioned within the box-shaped metal pan 14 which, as illustrated by FIGS. 5-10, is defined by a generally horizontally planar bottom wall 21 which, adjacent edges thereof, is joined to upwardly protruding edge or side walls 22 which cooperate with the bottom wall to define an upwardly-facing shallow compartment 20 in which the preformed main block 12 is positionable.

Figure 7:
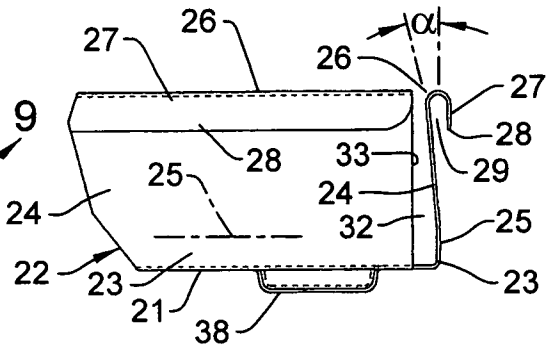
FIG. 7 is an enlarged fragmentary view showing the corner of the pan illustrated in FIG. 6.
Figure 5:
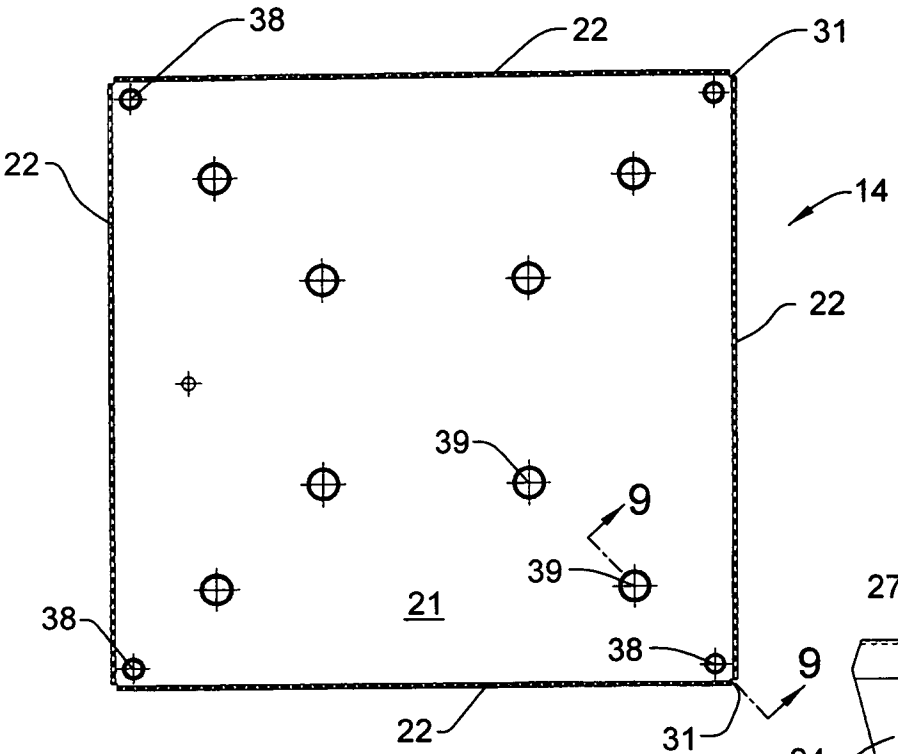
FIG. 5 is a top or plan view of the metal pan used in the construction of the floor tile according to a preferred embodiment of the present invention.
Figure 6:
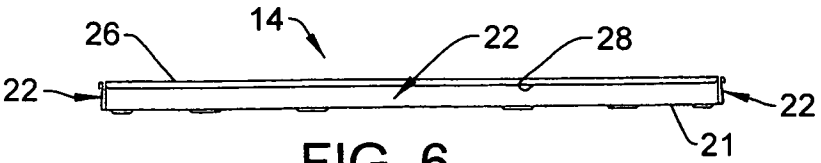
FIG. 6 is a side elevational view of the pan illustrated in FIG. 5.
Figure 8:
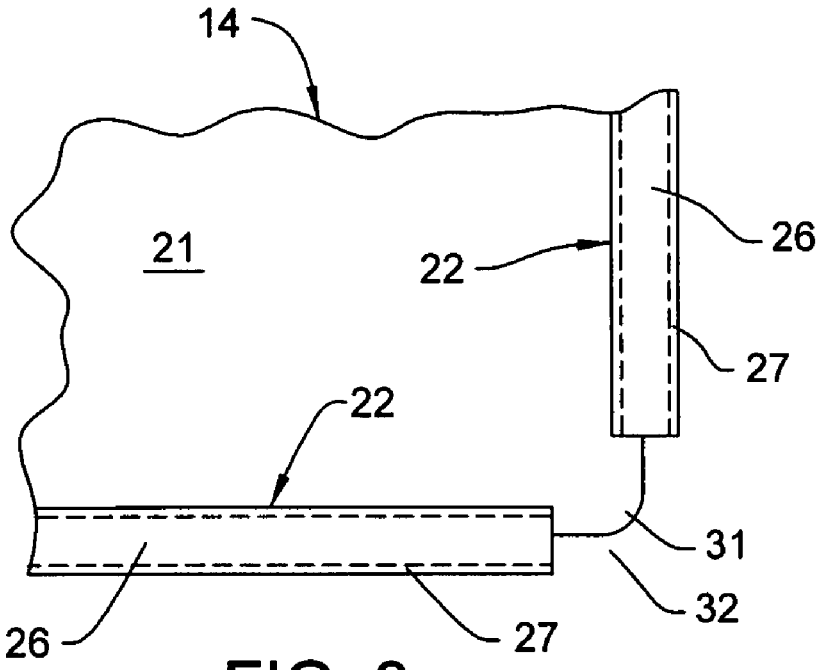
FIG. 8 is an enlarged fragmentary top view of the corner portion of the metal pan shown in FIG. 7.
Figure 10:
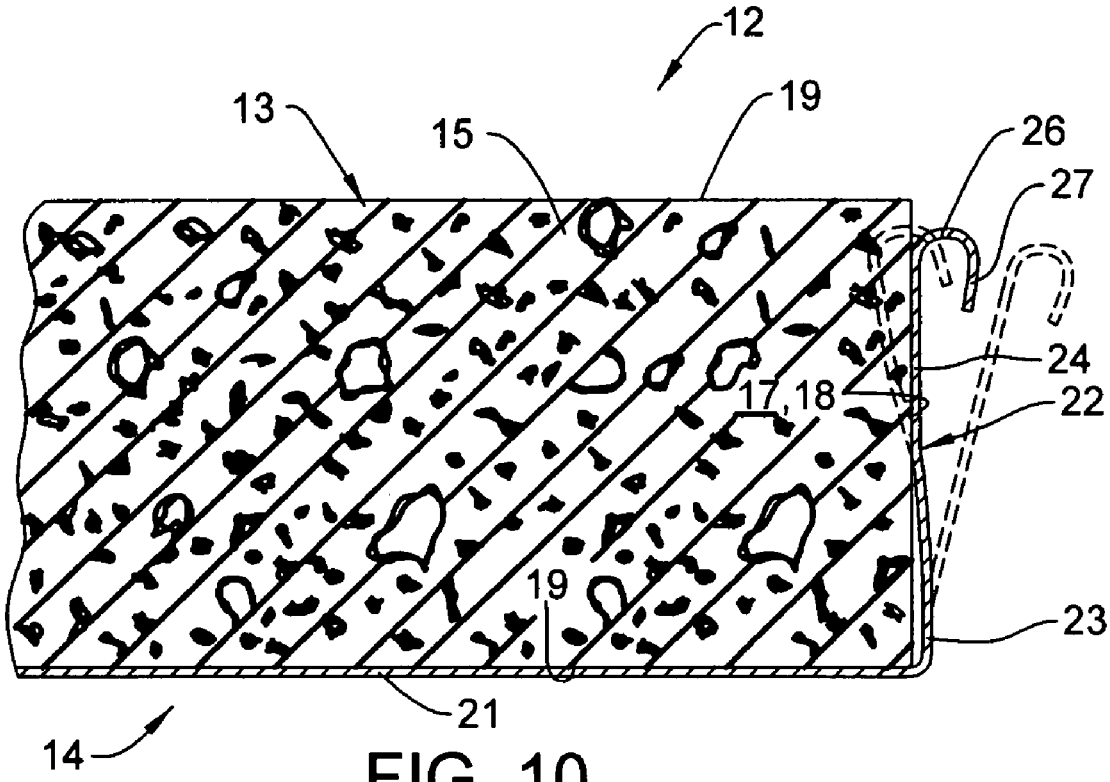
FIG. 10 is an enlarged fragmentary sectional view showing the preformed concrete block secured within the metal pan, and also showing the initial and deflected positions of the pan side wall which exist prior to and during installation of the preformed concrete block.
Figure 11:
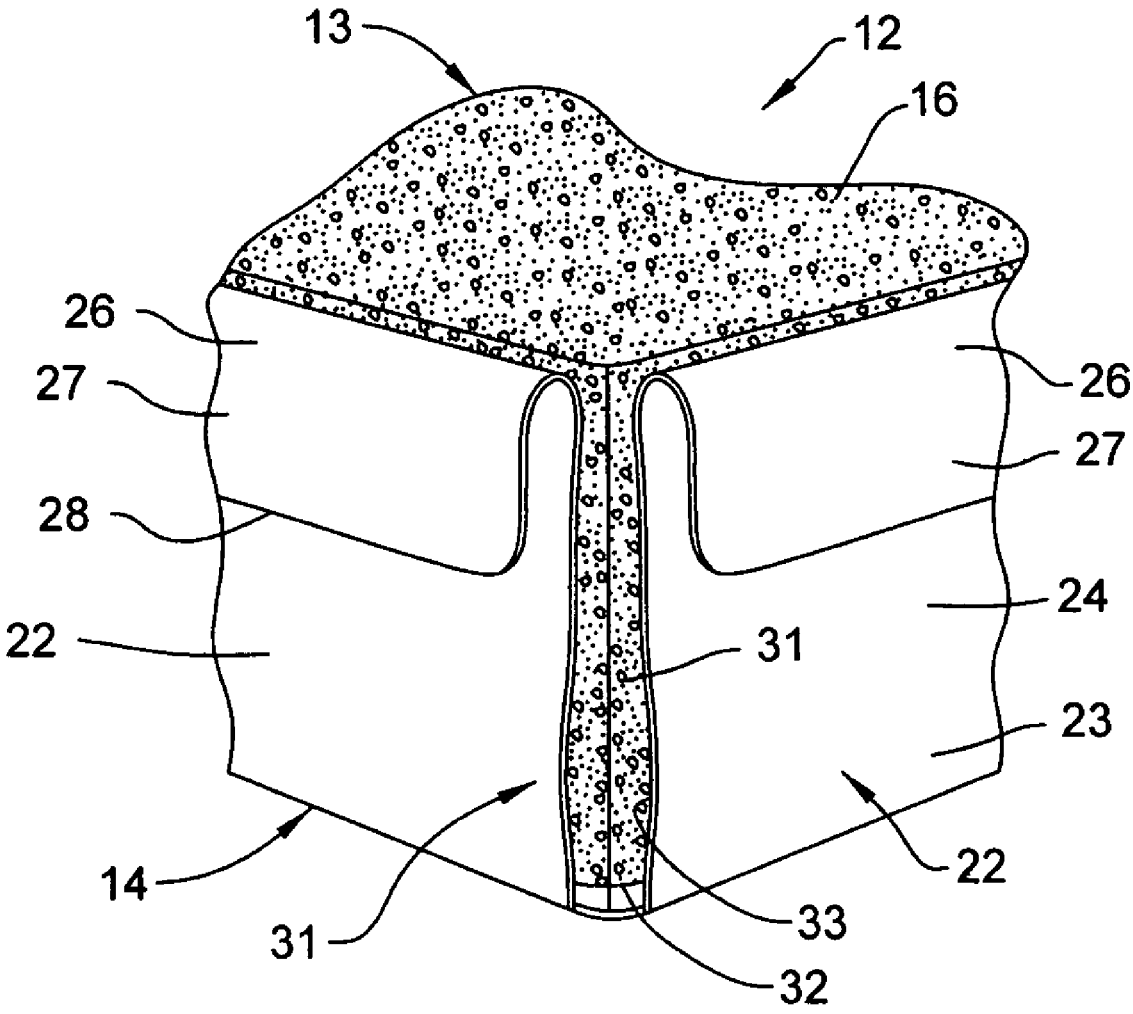
FIG. 11 is a fragmentary perspective view, taken partially from above, and showing a corner of the assembled floor tile.

Each pan side wall 22, as illustrated by FIGS. 7 and 10, has a lower wall part 23 which protrudes upwardly from the bottom wall 21 in generally perpendicular relationship therewith. Lower wall part 23 joins to an upper wall part 24 which is cantilevered upwardly at a slight angle relative to the vertical, which angle is inclined slightly inwardly toward the interior of the pan compartment. This upper wall part 24 joins to the lower wall part 23 generally at a bend or flex line 25 which extends throughout the length of the respective side wall. This upwardly cantilevered side wall 22, adjacent its upper edge, is provided with a reverse bend 26 creating a hem or flange part 27 which protrudes downwardly a limited extent in overlapping relationship to the exterior surface of the respective side wall 22. The hem or flange 27 terminates in a lower free edge 28 which is spaced upwardly a substantial distance from the bottom of the pan. The flange 27 cooperates with the side wall 22 to define a downwardly-opening groove or channel 29 therebetween.

The pan 14, at each of the upright corners 31 thereof, is provided with a slit or slot 32 which opens downwardly from the upper edge of the side walls 22. This slit or slot is terminated and defined by the end edges 33 of the adjacent upright side walls 22.

The pan 14 also has positioning projections 38 formed in and protruding downwardly from the bottom wall 21, with one such positioning projection 38 being positioned in close proximity to and slightly inwardly spaced from each of the pan corners 34. The positioning projection 38 is in the illustrated embodiment formed generally as a downwardly displaced cylindrical or conical projection, and is preferably deformed downwardly from the bottom wall of the pan in such manner as to prevent formation of any openings or cracks in the bottom wall. The positioning projections 38 are exposed, shaped and sized to cooperate with positioning recesses associated with the support pedestals, as explained hereinafter.

The bottom wall 21 of pan 14 may also be provided with one or more stiffening projections 39 formed therein, which are also preferably downwardly deformed from the bottom wall 21 so as to be free of any openings through the bottom wall, while at the same time providing the bottom wall with increased stiffness.

The metal pan 14 is preferably formed from thin metal, typically steel sheet, and can be suitably shaped utilizing conventional forming techniques such as stamping, roll forming or the like. The shaping of the pan 14 is such, however, that the side walls 22 are normally slightly angularly inclined as they project upwardly, as depicted by the angle $\alpha$ in FIG. 7, with these side walls 22 being grippable, as by use of the hem, so as to be angularly deflected outwardly into a position wherein they are slightly outwardly inclined relative to the vertical, substantially as illustrated by the dotted line position shown in FIG. 10. The outward deflection of the side walls 22 facilitates the positioning of the one-piece concrete main block 13 within the pan during assembly therebetween, with release of the outwardly deflected side walls 22 enabling the side walls to resiliently spring inwardly into gripping contacting engagement with the edge faces 17 and 18 of the main block 13.

Figure 12:
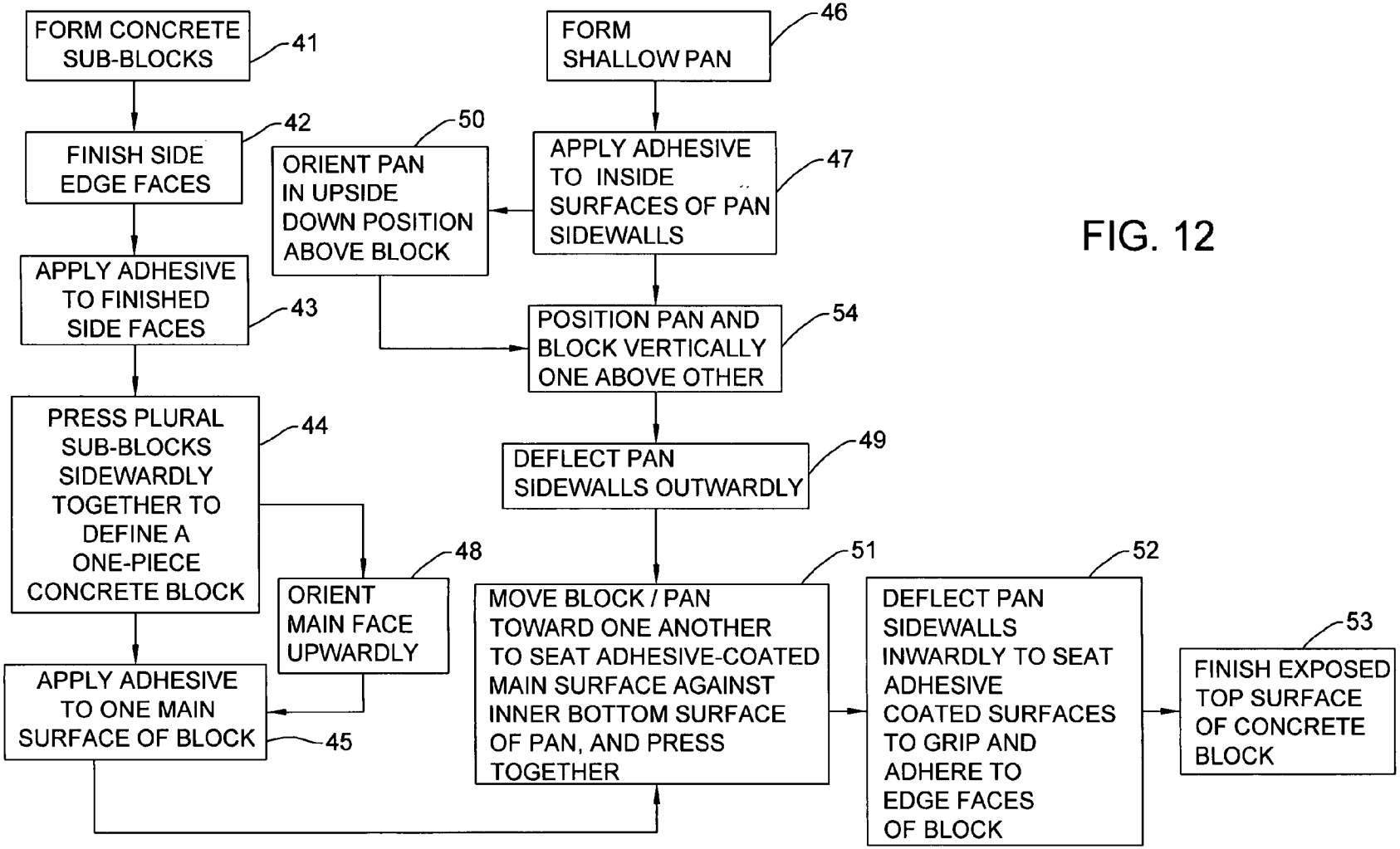
FIG. 12 is a flow diagram which illustrates the forming process for the floor tile illustrated in FIGS. 2-11.

Referring now to FIG. 12, there is diagrammatically illustrated a preferred manufacturing process for the floor tile 12. As indicated at step 41, the concrete sub-blocks 15 are initially preformed. These sub-blocks 15 are then preferably subjected to an edge finishing (step 42), namely grinding of the side edge faces 17 to provide improved surface uniformity and flatness. The side faces 17 then have adhesive applied or sprayed thereto as indicated at step 43, which adhesive is applied only to those selected edge faces 17 which are directly opposed to one another when the plural (i.e. three) sub-blocks 15 are disposed in generally co-planar side-by-side relationship. At step 44 the three sub-blocks 15 are then pressed together so that the adhesively-coated long edge faces 17 contact one another and the sub-blocks define a generally square profile. The sub-blocks 15 are pressed together for a sufficient period of time to enable the adhesive to dry and create a secure rigid structural joint between the sub-blocks to hence create the one-piece main block 13. The corners of the block are then chamfered, as by grinding, to create small flats extending angularly across the corners. The main block 13, as indicated at step 48, is preferably oriented so that the bottom wall 19 is oriented upwardly, following which (at step 45) an adhesive is applied over the entire upwardly-oriented bottom surface 19 of the main block.

Simultaneous with or prior to the above block forming steps, the shallow metal pan 14 is formed at step 46, and adhesive (i.e. hot melt) is applied to inside surfaces of the pan side walls as indicated at step 47. The pan, as indicated at step 50, is preferably oriented in an upside down relationship, i.e., oriented so that the compartment thereof opens downwardly, and the side walls 22 of the pan are engaged, such as by gripping the hems on the pan, and deflected outwardly as indicated at step 49. With the pan and adhesive-coated block oriented vertically one above the other (step 54), specifically with the pan oriented above the block, the pan is moved downwardly (step 51) to telescope over the block 13, which downward movement continues until the adhesively coated upwardly-facing bottom surface 19 of the block contacts the bottom wall of the pan, following which the pan and block are pressed together to allow the adhesive to set up and create a fixed securement of the block to the bottom wall of the pan.

After the block has been telescopically fitted into the pan as indicated at step 51, the side walls of the pan are released or deflected inwardly (step 52) so that they return back towards their original position so as to grippingly engage the edge faces of the block. Since the inner surfaces of the pan side walls 22 have adhesive applied thereto, the adhesive is pressed into contact with the edge faces of the block 13 and creates a rigid securement between the pan edge walls 22 and the edge faces of the block. After the block has been appropriately adhesively fixed within the pan throughout both the bottom and side walls thereof, the composite floor tile construction can then be moved to a finishing station, such as indicated at step 53, to permit grinding of the exposed top surface 16 of the concrete block 13 to create the desired smoothness and appearance.

In the preferred manufacturing process for the floor tile 12 as described above relative to FIG. 12, the adhesive securement between the bottom surface 19 of the block and the opposed bottom wall 21 of the pan is preferably achieved by initially applying a coating of adhesive directly to the exposed bottom surface 19 of the block 13 prior to positioning of the block within the pan compartment. By applying the adhesive directly to the bottom surface 19 of the main block, the adhesive is able to more readily coat and adhere to the entirety of the bottom surface 19, which surface necessarily involves some degree of roughness and porosity due to its having been formed from a concrete mix. This more intimate coating of the bottom surface 19 with the adhesive, when the adhesive coated bottom surface is pressed into contact with the bottom wall 21 of the pan, then provides for a more uniform and extensive coating of adhesive being pressed into intimate contact between the entire surface area of both the bottom surface 19 and the bottom pan wall 21. As the adhesive cures and solidifies, the adhesive hence creates a very strong and rigid securement between the pan bottom wall 21 and the bottom surface 19 of the block 13 which extends over substantially the entirety of the bottom surface 19. The area of surface adherement and the quality of the adherement is hence significantly improved and thereby provides highly improved rigid securement of the concrete block 13 within the pan 14.

While the coating of the bottom surface 19 of the block with adhesive is believed all that is necessary in order to achieve a proper adhesive securement with the bottom wall of the pan, it will be appreciated that, if felt necessary or desired, the upper surface of the pan bottom wall 21 could also have an adhesive coating applied thereto, such as sprayed thereon.

As to the adhesive coating which is applied between the block edge faces 17 and the pan side walls 22, this adhesive coating is preferably provided on the inside surfaces of the pan side walls 22 prior to fitting of the block 13 within the pan compartment 20, and the block edge faces in this preferred process are not adhesively coated. By avoiding direct application of adhesive to the edge faces of the block, this minimizes the possibility of excess adhesive being accidentally squeezed outwardly so as to project upwardly beyond the upper edge of the block, particularly since the upper edge of the block is spaced upwardly a small distance above the top edge of the pan side walls 22. Excess or extra cleanup of the floor pan due to excess or undesired adhesive being extruded out or passing beyond the upper edges of the block is hence avoided or at least greatly minimized.

In addition, by applying the adhesive to the inside surfaces of the pan side walls 22, but not to the edge faces of the block, and by outwardly angularly deflecting the pan side walls 22 prior to insertion of the block 13 into the pan compartment 20, this minimizes the possibility of adhesive being scraped upwardly beyond the upper edges of the block during assembly of the block into the pan.

More specifically when the inverted pan 14 is moved downwardly so as to be telescoped over the inverted block 13, as described above, the manner of cooperation between the edge faces of the block and the deflected side walls 22 of the pan is such as to prevent or minimize any tendency for the adhesive on the side walls to be scraped off during the positioning of the pan and block in engagement with one another. If any such contact occurs between the pan and block as the pan telescopes downwardly over the block, such contact will likely occur between the side walls and the bottom edge of the block, which hence would tend to displace any adhesive toward the bottom of the pan (and specifically away from the exposed top face of the block) so as to trap any such adhesive in the lower corners or edges of the pan.

Further, when the pan side walls 22 are released and moved into gripping engagement with the block, the inclined configuration of the pan side walls, namely their slight inward incline, tends to squeeze any excess adhesive downwardly toward the bottom of the pan, rather than outwardly toward the upper surface of the block, thereby minimizing escape of adhesive from the upper edge of the pan.

The process as described above is hence believed to optimize the fixation strength of the adhesive attachment between the block and the pan, particularly with respect to the rigid securement of the bottom surface of the block to the pan bottom wall so as to provide significant reinforcement for the bottom of the block to hence withstand the otherwise damaging tension forces which are created adjacent the bottom surfaces due to the vertical downward loading imposed on the block. At the same time, this process minimizes the escape of adhesive and hence minimizes any necessary or required subsequent cleanup due to escape of adhesive.

In the present invention, the adhesive for creating a fixed securement between the metal pan and the concrete block is preferably a conventional thermosetting hot melt, such as a urethane adhesive, which hot melt is typically and preferably applied to the respective surfaces by spraying.

The floor pan construction and manufacturing process in accordance with the preferred embodiment of the invention, particularly as illustrated and described above with respect to FIGS. 2-12, is particularly desirable with respect to providing increased efficiencies relative to the manufacturing of the floor tile while at the same time maintaining or providing improved strength characteristics while permitting utilization of a simplified configuration and construction of both the concrete block and pan. In particular, since the concrete block associated with the pan (such as the main block 13) is typically a 24 inch by 24 inch square, such large block, when initially molded in one piece, is difficult and time consuming to mold and to handle subsequent to molding since its size greatly restricts not only the rate of molding, but also the subsequent handling required to position and secure the block within the preformed metal pan. On the other hand, in the present invention the sub-blocks in accordance with the preferred embodiment are approximately 8 inches by 24 inches, whereby the three sub-blocks when adhesively fixed together result in the desired 24 inch by 24 inch square main block. The smaller sub-blocks, however, permit forming of large quantities of sub-blocks within a block molding machine which includes a large number of mold cavities oriented in an upright manner so that the 8 inch width of the sub-block is oriented in an upright direction. In this manner, the sub-block can be properly molded in an upright condition within the block molding machine due to the smaller height of the sub-block, while at the same time a molding machine of reasonably small size and space has the capability of simultaneously molding, in a single operation, a large number of sub-blocks. Further, when the plurality of sub-blocks are discharged from the machine, they can be maintained in adjacent upright relationship so as to permit drying and subsequent handling, while again minimizing the overall space requirements and the size of associated machinery and equipment needed for handling the sub-blocks. The overall net effect is a substantial increase in productivity, specifically the number of overall blocks which can be manufactured, relative to the size, space and speed with which the 24-inch square blocks can be molded in accordance with prior known technologies.

To create the preformed sub-blocks as described above, the concrete mix preferably utilizes Portland cement both due to its lower cost and its dimensional stability, and the concrete mix, i.e., Portland cement, aggregate, water and other conventional fillers, when poured into the mold is preferably in a condition conventionally referred to as "dry mix" in that a minimum quantity of water (typically a maximum of 10 percent by weight) is utilized and this improves the strength of the finished sub-block and greatly minimizes the drying or curing time, such as by reducing the curing time from several days to about one day or less. The "dry mix" also permits the formed but non-cured blocks to be rapidly removed from the mold so as to maximize the production rate of the mold, with the formed but non-cured blocks when removed from the mold being supported in an upright condition while they undergo their remaining curing phase, resulting in a faster production rate while minimizing storage or floor space for support of the blocks during the curing phase. The overall production rate is thus significantly increased so as to be suitable for high volume production.

With the improved floor tile and manufacturing process of this invention as described above, the preformed concrete block in a conventional construction will typically have a thickness of about 1⅛ inch. In situations where greater floor loads are anticipated and higher strengths are required, however, the block thickness can be increased, such as up to about 1½ inches, by modifying the width of the mold cavities within the mold machine. The thicker preformed blocks, however, may fit within the same or thicker pan and can be adhesively fixedly secured within the pan in the same manner described above. This manufacturing process, and mechanical design of the floor tile, hence readily permits selective variation, at least within a permissible range, in the thickness of the concrete block and in the resulting thickness of the floor tile so as to optimize floor tile strength relative to anticipated external loads.

While a manufacturing process utilizing a preformed concrete core block in accordance with the aforementioned disclosure is believed highly preferable and desirable in many use environments, it is recognized that in some situations it may be considered more desirable to resort to a process wherein the concrete is poured in a wet form into the pan so as to mold the block directly within the pan. An improved process utilizing this general technique is diagrammatically illustrated by FIG. 13.

More specifically, in this improved process the shallow box-shape metal pan is again formed as indicated at step 61. In this process, however, the pan need not be formed with slits at the corners thereof since the process does not require deflection of the pan side walls. The interior of the pan is coated with a suitable adhesive, such as a hot melt, as by spraying the inner surfaces of the bottom and side walls of the pan. A thin layer of fine grain sand (step 63) or other suitable fine granular aggregate material is then sprinkled over the adhesive coating on at least the bottom wall of the pan. In accordance with one technique, a second layer of adhesive is then applied to the inner wall of the pan directly over the sand layer (step 65) so as to ensure intimate coating of the sand layer with adhesive. The wet concrete mix is prepared (step 64) and is then deposited in the pan (step 66) so as to fill the compartment, with the concrete mix in the pan being leveled in a conventional manner. The concrete in the pan is then allowed to harden (step 67), and during this hardening the adhesive layer and the intermingled sand granules set up and create a strong and intimate fixing of the hardened concrete core to the metal pan. After appropriate hardening, the top surface of the concrete core as formed within the pan is then finished (step 68) to provide the desired smoothness and visual appearance.

Figure 13:
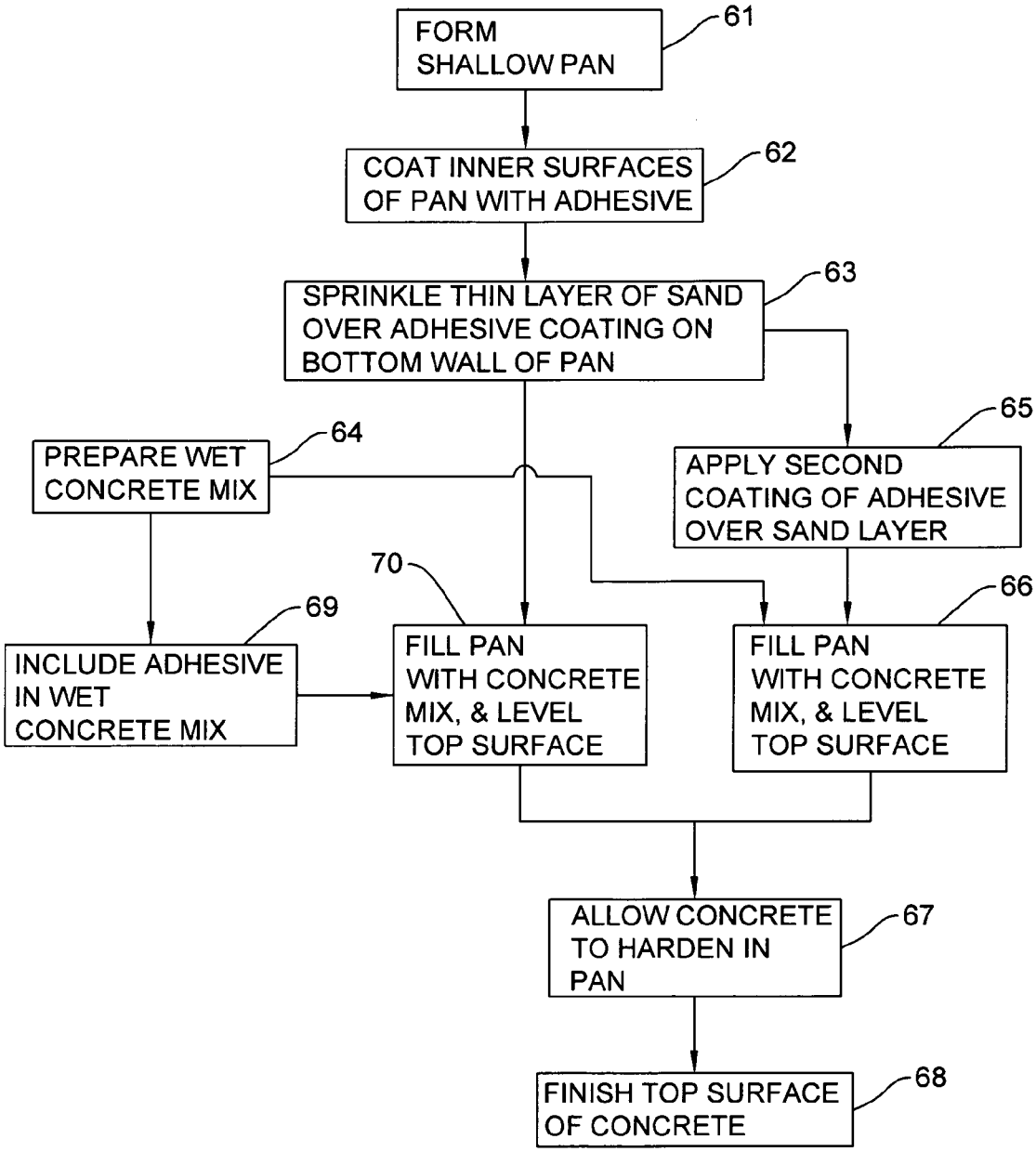
FIG. 13 is a flow diagram which illustrates an alternative forming process for a floor tile useable in a raised floor.

As a variation to the aforementioned process, as also indicated in FIG. 13, in place of applying the second adhesive layer to the pan, the wet concrete mix can instead be provided with an adhesive which is mixed into the wet concrete mix (step 69), which wet mix is thereafter placed into the pan (step 70) and allowed to harden, whereupon the adhesive in the wet concrete mix coacts with the adhesive and sand previously applied to the pan to create a strong and intimate fixing of the hardened concrete to the metal pan.

Referring now to FIGS. 14-18, there is illustrated an improved height-adjustable floor pedestal 71 in accordance with the present invention. A plurality of such pedestals are disposed in a grid pattern on a floor, similar to the arrangement illustrated by FIG. 1, to permit support of the floor tiles 12 thereon, as explained in greater detail hereinafter.

Figure 14:
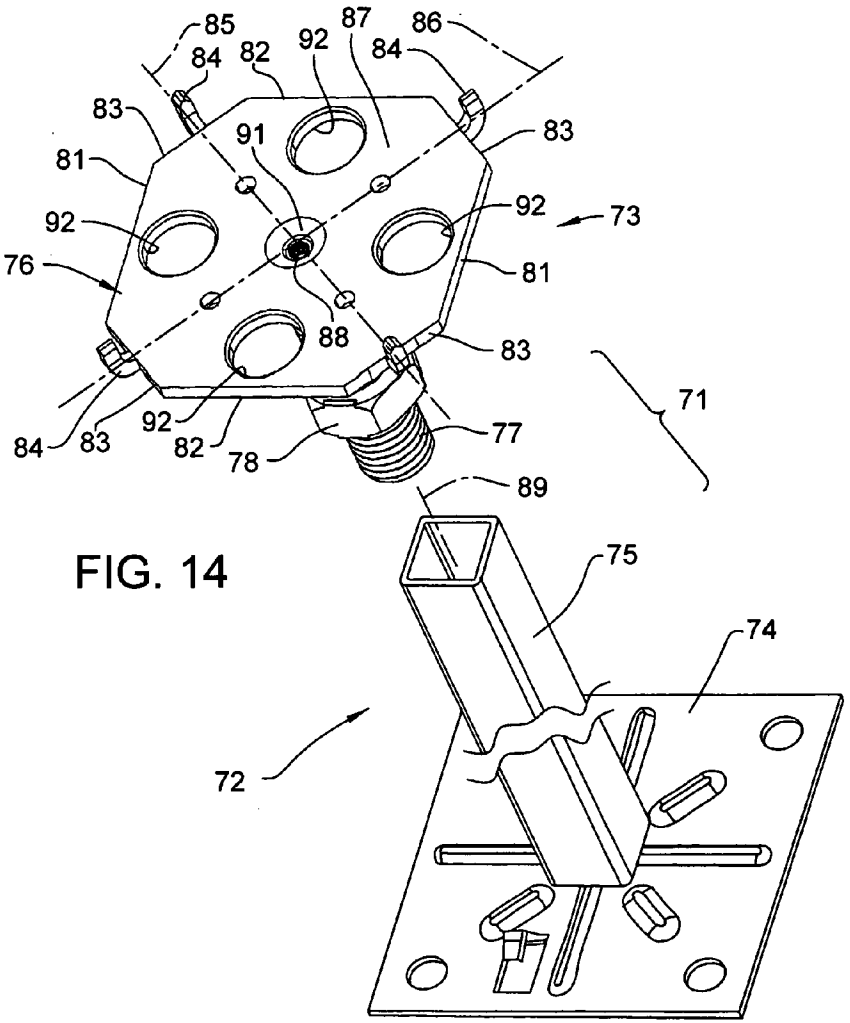
FIG. 14 is an exploded perspective view of a pedestal assembly used in conjunction with the floor tile for defining a raised floor according to the present invention.
Figure 15:
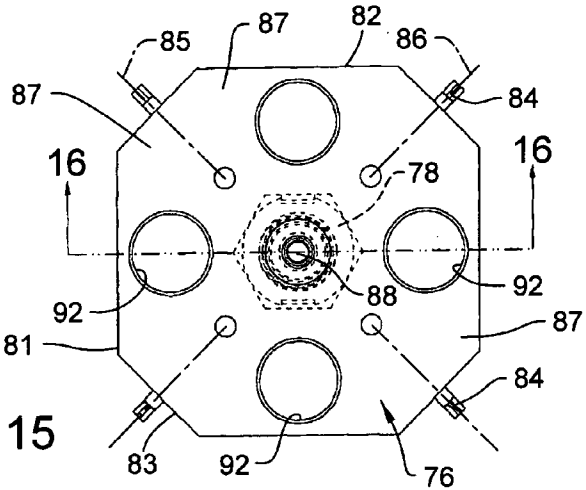
FIG. 15 is a top view of the pedestal assembly shown in FIG. 14.
Figure 16:
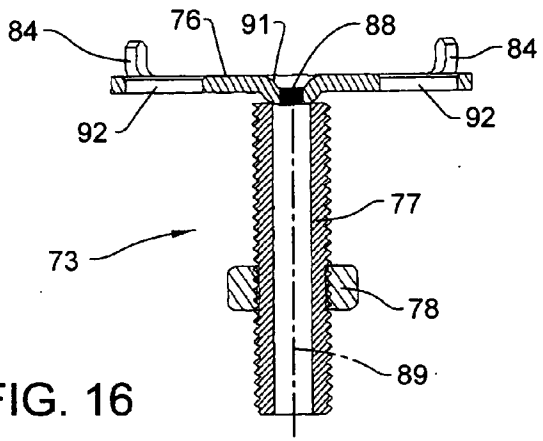
FIG. 16 is a central sectional elevational view taken generally along line 16-16 in FIG. 15 and showing solely the pedestal head assembly.

The support pedestal 71 as illustrated by FIGS. 14-16 is defined principally by a base arrangement 72 which is adapted to be supported on a floor so as to project upwardly therefrom, and a height-adjustable head assembly 73 which is supported on the upper end of the base assembly 72.

The base assembly 72 includes a generally horizontally-extending base plate 74, typically of steel, having a vertically elongate support column 75 fixed thereto and cantilevered upwardly therefrom. The support column 75 in the illustrated embodiment is defined by an elongate hollow square tube.

The head assembly 73 includes a support or shelf 76 which is defined generally by a horizontally extending plate, typically a steel plate which is attached to the upper end of a downwardly projecting support post 77. The post 77 is threaded and has a nut 78 engaged thereon, the latter being adapted to bear against the upper end of the support column 75 when the post 77 is inserted into the interior of the column.

The horizontal support shelf 76 in the illustrated arrangement has a generally octagonal exterior shape defined by two pairs of parallel side edges 81 and 82, which pairs 81, 82 extend in perpendicular relationship to one another, with additional side edges 83 extending in angled relationship between ends of the adjacent side edges 81 and 82. The support shelf 76 has a set of positioning projections 84 fixed to and projecting upwardly adjacent the periphery thereof in angularly spaced relationship therearound. More specifically, there are four such positioning projections 84, one associated with each of the angled or corner edges 83, with these positioning projections 84 being disposed so that two of them lie along one axis 85 adjacent opposite sides of the support shelf, and the other pair of projections 84 lie along the other axis 86 on opposite sides of the support shelf. The axes 85 and 86 extending generally in perpendicular relationship to one another so as to define the support shelf 76 into four substantially identical quadrants or sectors 87, each being adapted to supportingly engage one corner of a floor tile 12.

The horizontal shelf 76, at the center or midpoint thereof, as defined by the intersection of the axes 85 and 86, has a threaded opening 88 extending vertically therethrough. This opening is concentric to the central vertical axis 89 of the support post 77. The threaded bore 88 communicates with a conical counterbore 91 which opens upwardly for communication with the upper surface of the shelf 76.

Each quadrant or sector 87 of the shelf 76 has a positioning recess 92 formed therein and extending vertically through the support shelf. This recess 92 is disposed generally on a radial line which bisects the respective sector and is angularly midway between the two adjacent positioning projections 84. The four positioning recesses 92 are hence disposed in an annular array spaced at angles of 90 degrees apart, and the positioning projections 84 are similarly disposed in an annular array spaced at angles of 90 degrees apart, with the array of positioning openings 92 being angularly offset 45 degrees relative to the angular positions of the positioning projections 84.

Figure 17:
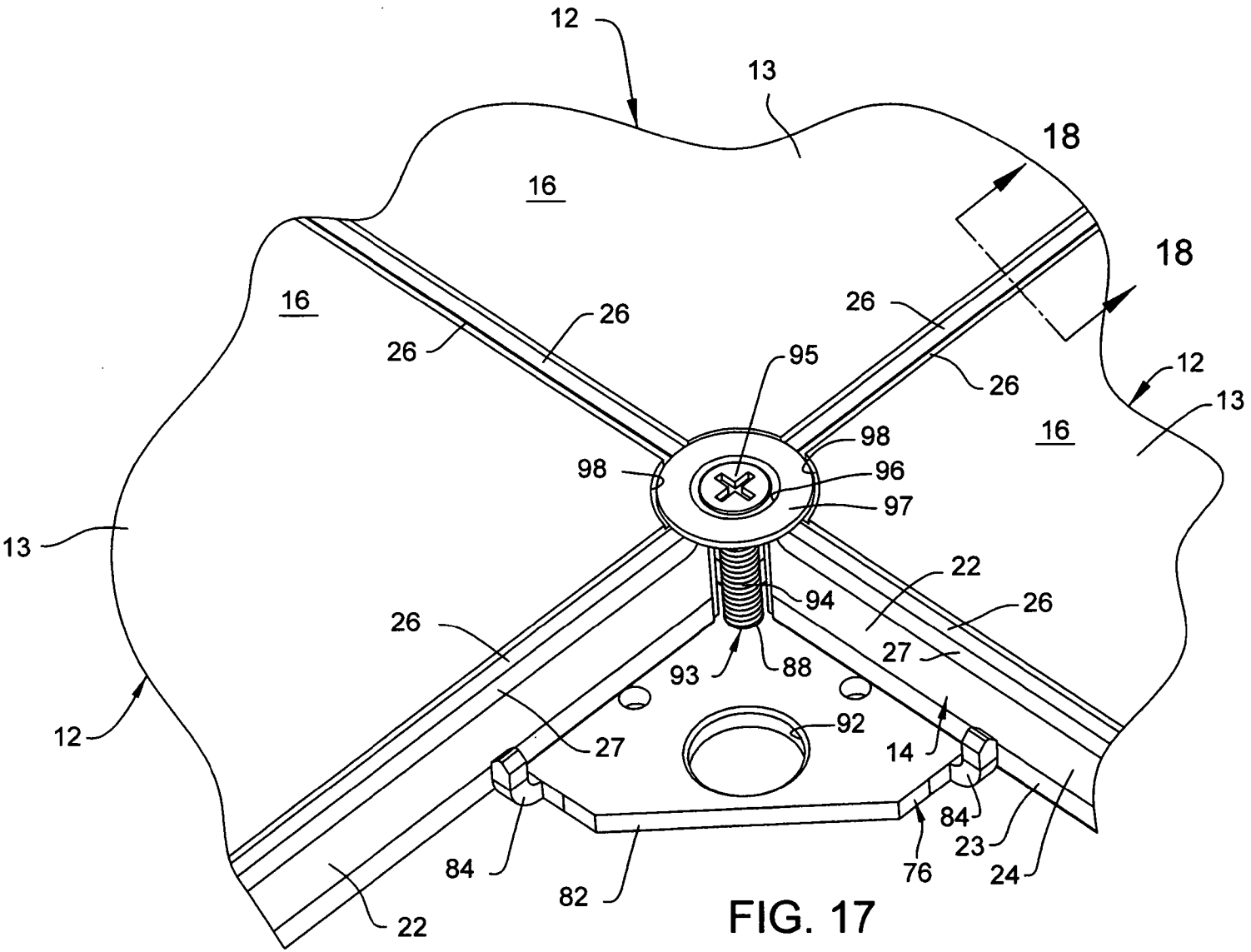
FIG. 17 is an enlarged fragmentary perspective view illustrating the manner in which a fastener assembly cooperates with the pedestal head and a plurality of floor tiles for securing the latter to the pedestal head.
Figure 18:
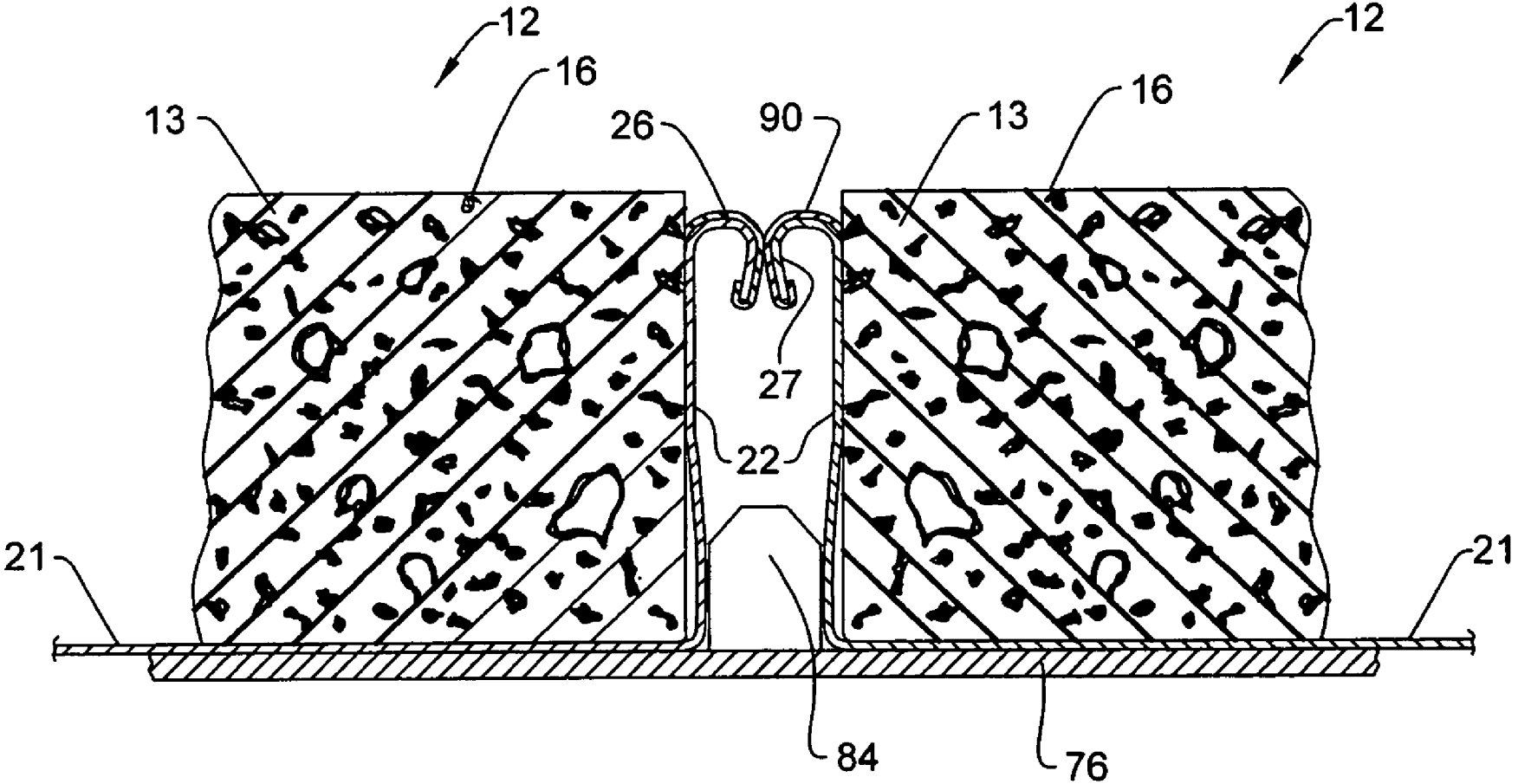
FIG. 18 is a fragmentary sectional view taken generally along line 18-18 in FIG. 17.
Figure 19:
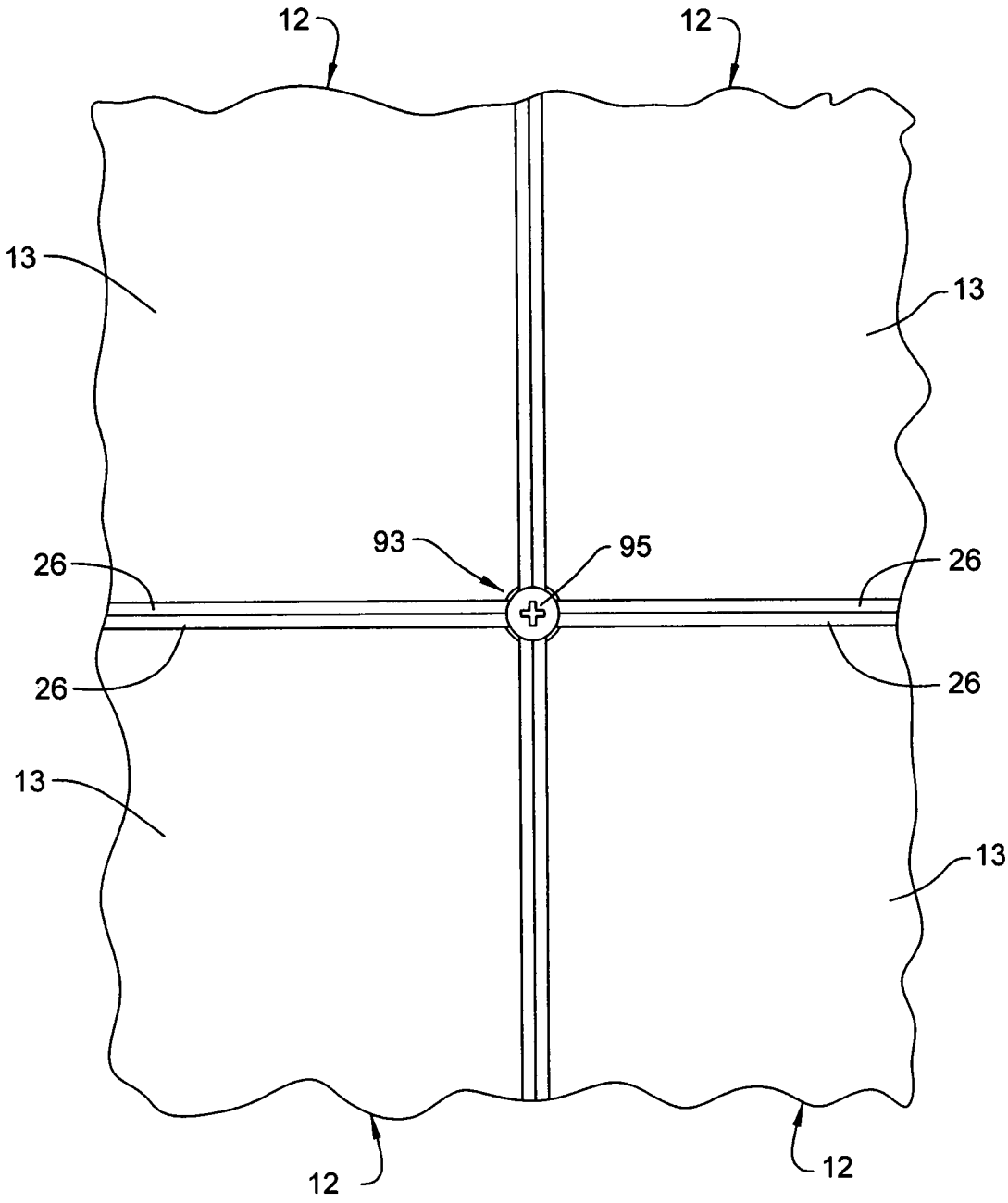
FIG. 19 is a fragmentary top view which illustrates the disposition of four floor tiles over a pedestal and specifically the fastener which cooperates adjacent the corners of the floor tiles for securing the latter to the pedestal.
Figure 20:
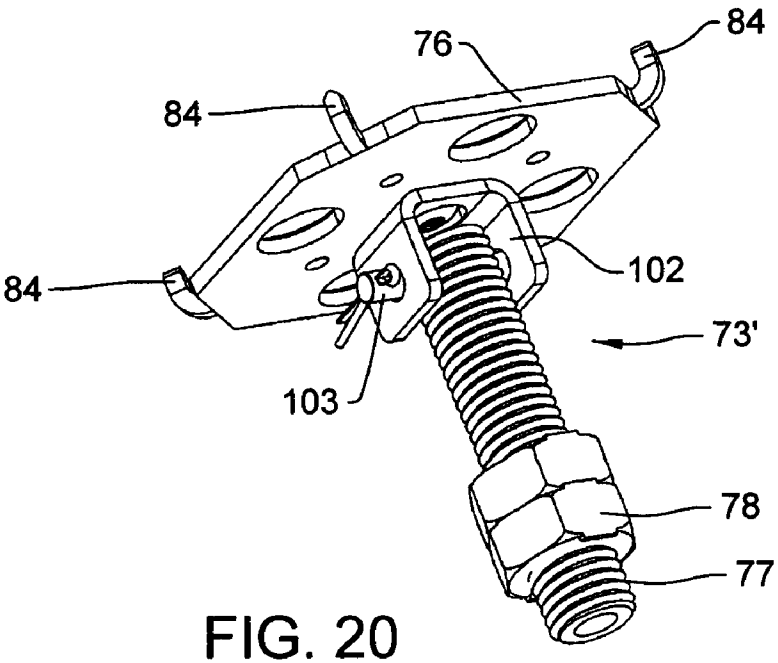
FIG. 20 is a perspective view of a variation in the pedestal head assembly, specifically to permit pivoting of the support shelf.

As illustrated by FIG. 17, the pedestal assembly includes a fastener arrangement 93 which cooperates with the head assembly 73 for securing corners of the floor tiles 12 thereto. Specifically, the corners of the floor tiles 12 are disposed in vertical supportive engagement with the upper surface of the support shelf 76, with the corner of the specific floor tile being disposed so that the side walls thereof are engaged between an adjacent pair of positioning projections 84, whereby the corner of the floor tile is hence disposed closely adjacent but spaced radially from the threaded opening 88. When all four floor tiles 12 have been disposed in supportive engagement on the support shelf 76, then the threaded fastener arrangement is utilized to secure the floor tiles to the head assembly.

For the above purpose, the fastener assembly 93 includes an elongate threaded fastener or screw 94 having an enlarged conically-shaped head 95 at the upper end. The fastener cooperates with a hold-down washer 97 having a generally conical bore 96 formed therethrough for accommodating the conically shaped head 95 of the threaded fastener. The washer 97 is of sufficient diameter so as to overlap the upper corners of the adjacent floor tiles 12. In this regard, the upper surface of the concrete block 13 as associated with the floor tile is provided with a shallow arcuate recess 98 formed in the corner thereof. The depth of the recess 98 generally corresponds to the thickness of the washer 97 and corresponds generally to a depth which is flush with the uppermost edge of the bend 26. Hence, when the threaded fastener 93 is inserted through the washer 97 and threaded down into the threaded opening 88, the washer 97 is moved downwardly into snug gripping engagement with the concrete wall defining the bottom of the recess 98, and the washer remains substantially flush with the upper surface of the concrete blocks 13, whereby the floor tiles 12 are pushed downwardly and hence grippingly secured relative to the pedestal shelf 76. When so positioned, as diagrammatically illustrated in FIG. 18, the positioning projection 84 is disposed between a pair of sidewardly adjacent floor tiles 12, and the hems 27 associated with the sidewardly adjacent floor tiles are positioned in close proximity to one another. However, the sidewardly adjacent hems 27 are normally spaced a small distance apart and, to effect a sealing or closing off of this space, a suitable plastic or elastomeric sealing strip 90 can be attached to the free edge of each of the hems. Alternately, the sealing strip may be a T-shaped cross-section so as to be snapped into engagement with both hems while filling the gap therebetween.

Figure 21:
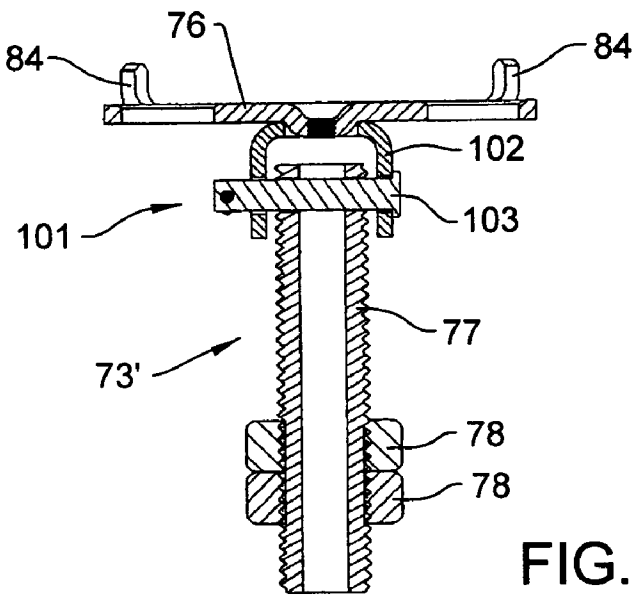
FIG. 21 is a central sectional view of the modified pedestal head assembly illustrated in FIG. 20.

The pedestal assembly can, as a variation to the construction identified above, be provided with a swivel arrangement 101 (FIG. 21) for coupling the support shelf 76 to the support post 77. The shelf 76 has a yoke 102 fixed thereto and projecting downwardly for engagement with a pivot pin 103 which is transversely supported on the post 77 adjacent the upper end thereof. This swivel arrangement enables the raised floor to be used to define a ramp or the like.

A further variation of the pedestal assembly is illustrated in FIGS. 22-25. In this variation all of the parts generally correspond to the pedestal assembly 73 described above except for the configuration of the top support shelf 76". With respect to this latter top support shelf 76", it is configured so as to have a generally hexagonal or six-sided profile in plan view, rather than the octagonal profile described above. This six-sided profile, as explained in greater detail below, permits the pedestal to be efficiently utilized for supporting floor tiles either at the corner of a single panel such as at a room corner, or along an upright wall so as to supportingly engage only an adjacent pair of floor tiles thereon, while at the same time permitting the entire pedestal to be disposed below the floor tiles.

Figure 22:
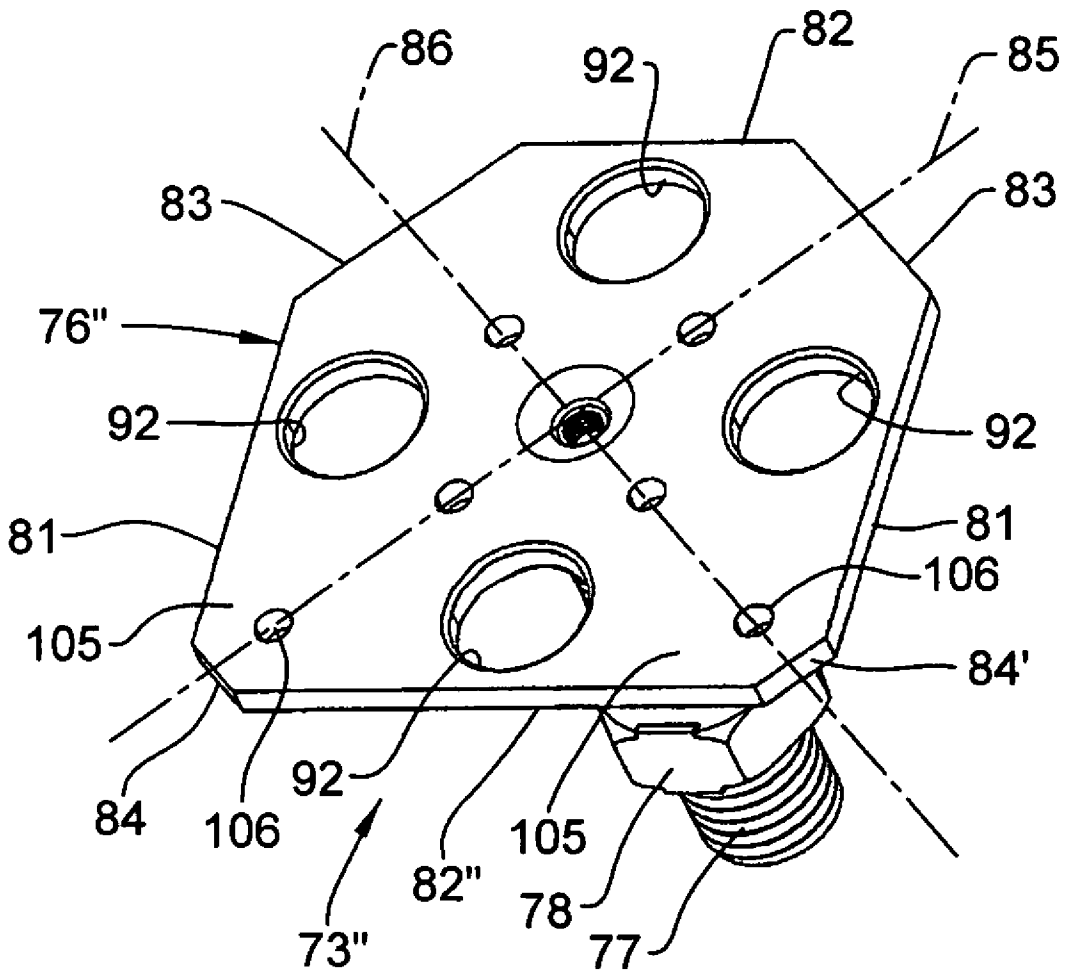
FIG. 22 is a perspective view of the pedestal head assembly employing a modified support shelf configured to cooperate with either a perimeter edge or a corner of a raised floor arrangement.

More specifically, and referring particularly to FIG. 22, the modified shelf 76" again includes sectors each having a locating recess 92, with these recesses being oriented in the same relationship relative to the transverse axes 85 and 86. Also, one half of the periphery again basically corresponds to one half of an octagon, namely as defined by one of the sides 82, the other sides 81, and the inclined sides 84 joined therebetween. The other side of the shelf 76", however, has a generally rectangular profile in that the corners are not removed, but rather are extended so as to define corner portions 105 as defined generally between the side 92 and the other sides 81 which extends perpendicular thereto. The sides 81 and 92 can directly intersect at the corners or, as illustrated by FIG. 22, the sharp corners can be removed, such as indicated by the corner edges 84', for convenience in handling and safety. In this modified construction of the shelf plate 76", each of the corner portions 105 has a threaded opening 106 extending vertically therethrough at a location positioned radially outwardly by a greater extent than the location of the positioning recesses 92. These threaded openings 106 are located generally on the transverse axes 85 and 86. Other than the provision of the corner portions 105 and the threaded openings 106 associated therewith, the modified shelf construction 76" otherwise corresponds to the shelf 76 described above.

Figure 23:
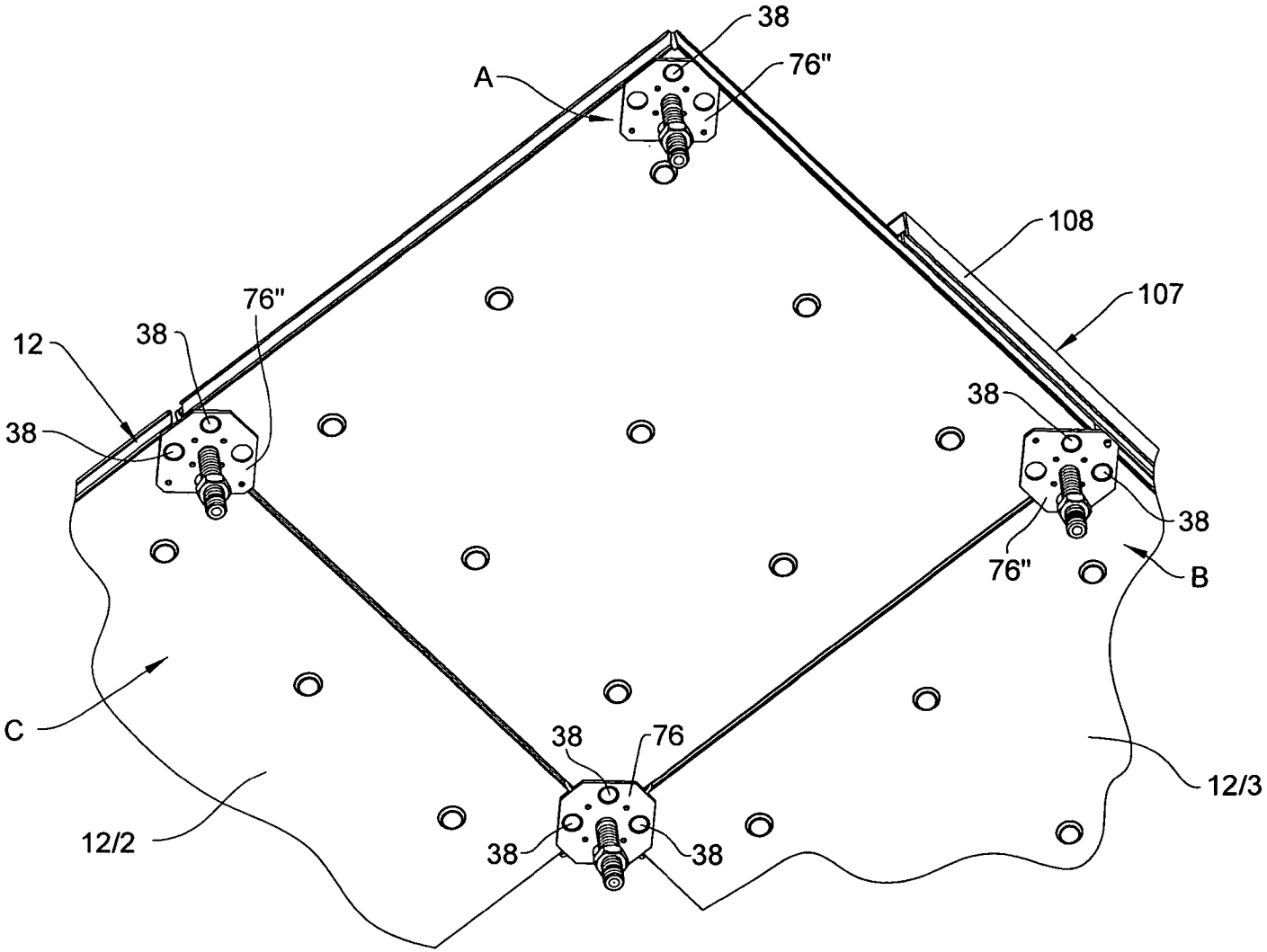
FIG. 23 is a perspective view, viewed generally from below a raised floor system, and illustrating the modified shelf associated with several pedestals and their cooperation with floor tiles, including a conventional pedestal which cooperates with the corners of four adjacent floor tiles, a pedestal which cooperates with the corners of two adjacent floor tiles defining the perimeter of the floor, and a pedestal which cooperates with the corner of a single floor tile which defines the corner perimeter of the floor.

In use, and referring to FIG. 23, a pedestal assembly employing the modified shelf 76" can be utilized either as a corner support under a single floor tile as illustrated at position A, or it can be utilized as a support for the corners of two adjacent wall tiles by locating the support directly adjacent the edge of the raised floor, as illustrated at positions B and C in FIG. 23.

It will be observed that the modified shelf 76", does not possess any upwardly protruding positioning projections 84 so as to permit its use entirely under the floor tiles in the manner illustrated by positions A, B and C.

To utilize the modified shelf 76" for supporting a floor tile corner in the manner illustrated at position A in FIG. 23, the shelf 76" is positioned entirely beneath a single floor tile, namely the tile 12/1 which defines the corner of the raised floor. The shelf 76" is positioned so that the angled corner edges 83 are disposed directly adjacent the perpendicular sides of the floor tile, thereby enabling the positioning recess 92 located between the corner edges 83 to be engaged with the downward positioning projection formed on the floor tile 12/1 adjacent the exposed corner thereof. When so positioned, the shelf 76" hence has a secure positional relationship with respect to the floor tile while at the same time the shelf 76" is disposed totally beneath the floor tile. This enables the floor tile to be positioned in close proximity to upright walls defining a corner.

Figure 24:
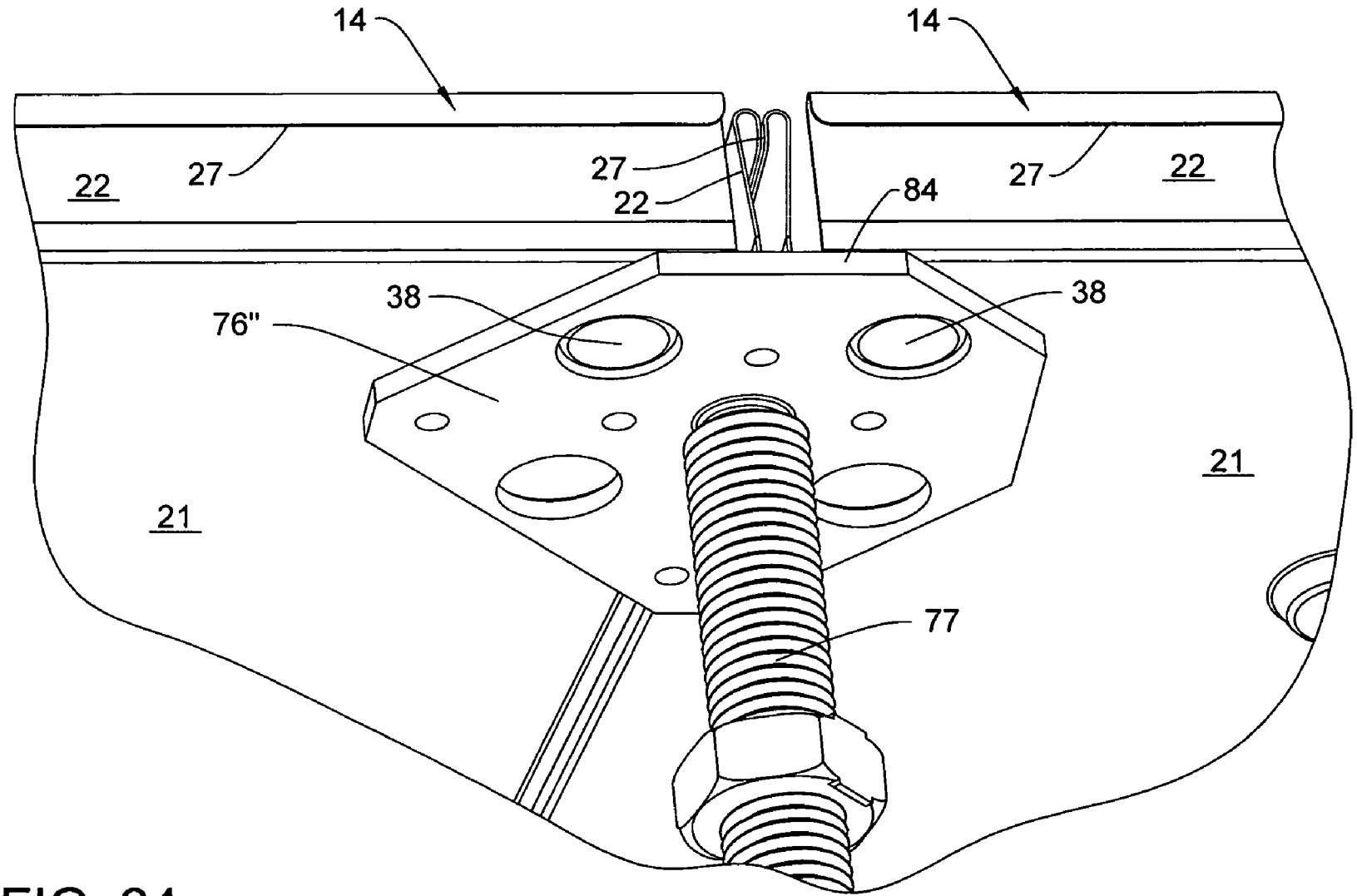
FIG. 24 is an enlarged perspective view, viewed from below the floor, and illustrating the modified pedestal head cooperating between two adjacent floor tiles and located at the perimeter of the floor.

When the modified shelf 76" is used at a periphery of the floor for supportive engagement at the joint between two tiles 12/1 and 12/2 as illustrated at position C in FIG. 23, the support shelf 76" is oriented so as to overlap the undersides of the two floor tiles at the adjacent corners, with one of the corner edges 83 on the shelf 76" being oriented closely adjacent and generally parallel to the exposed side edges of the floor tiles (see FIGS. 23 and 24). When so oriented, this permits the two adjacent locating recesses to be engaged with the locating projections associated with the corners of the two adjacent tiles to hence maintain the two tiles in proper positional and engaged relationship on the shelf 76".

As an alternative to the perimeter mounting illustrated at position C in FIG. 23, the modified shelf 76" can also be used at a perimeter position as illustrated at position B in FIG. 23, which perimeter position is configured so as to cooperate with a removable elongate edge trim rail 107 (see also FIG. 25) which is provided so as to extend along the edge of two adjacent floor tiles, such as when the floor tiles 12/1 and 12/3 terminate at and defines the edge of a step or the like.

Figure 25:
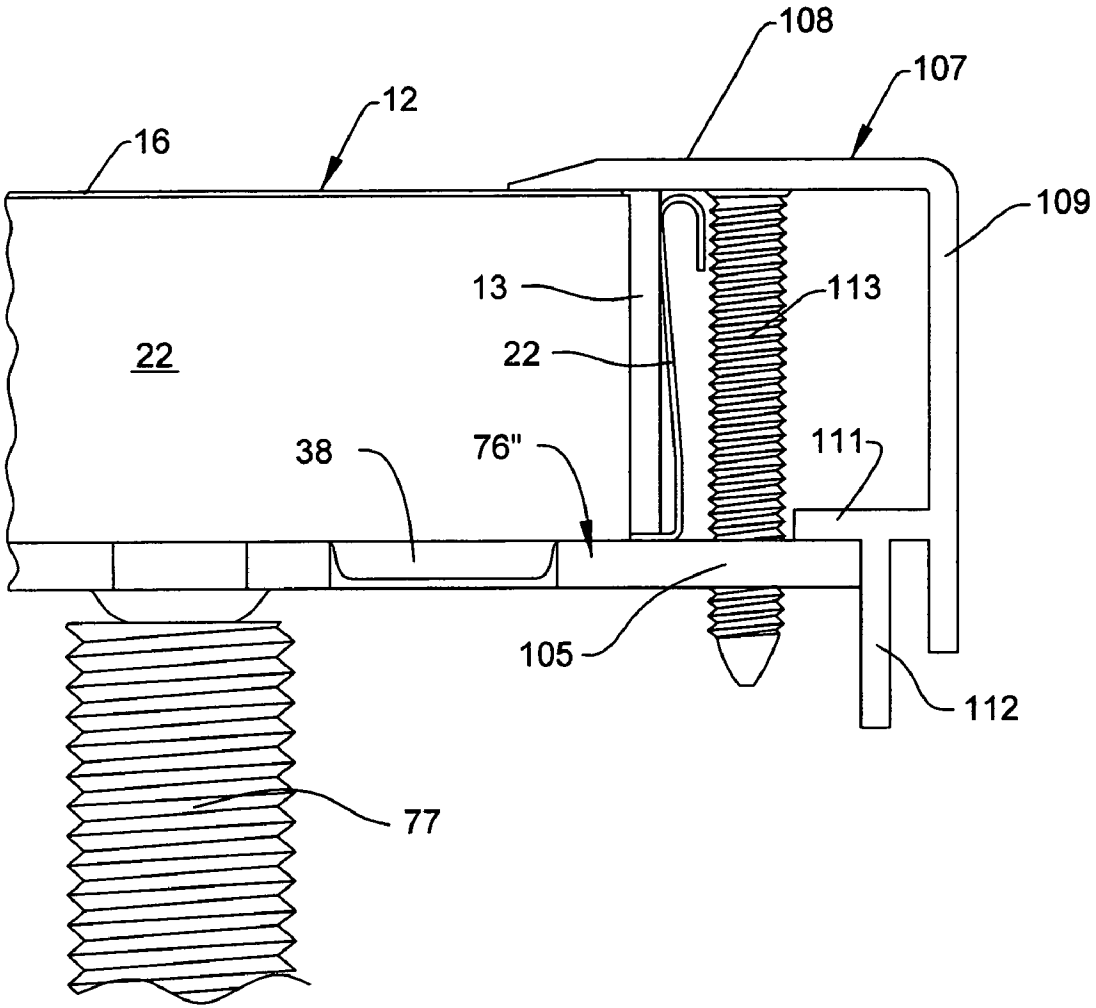
FIG. 25 is a fragmentary elevational view which illustrates the modified pedestal head and its cooperation at the perimeter of the floor, and which is designed specifically to cooperate with a trim rail which attaches to the edge of the floor tile.

As illustrated in FIG. 25, the edge rail 107 has a top leg 108 which overlaps the upper surface of the adjacent floor tile in close proximity to the exposed side edge thereof. This top leg 108 protrudes outwardly and is fixedly, here integrally joined to a downwardly protruding side leg 109 so as to define an L-shaped configuration. The side leg 109 adjacent its lower end joins to an inwardly protruding top abutment part 111, which in turn has a side abutment part 112 protruding downwardly therefrom. These latter parts are designed for abutment with a protruding edge of the shelf 76".

More specifically, and as illustrated by FIG. 23, the shelf 76" is positioned under the adjacent corners of the two perimeter floor tiles 12/1 and 12/3, and the shelf is oriented so that one of the corner portions 105 protrudes outwardly beyond the aligned side edges of the adjacent floor tiles. This enables the positioning protrusions 38 on the adjacent floor tile corners to engage within the appropriate positioning recesses 92, thereby positionally securing the floor tiles relative to the shelf 76", while enabling the corner portion 105 of the shelf to protrude outwardly beyond the side edges of the floor tiles as illustrated by FIG. 25. This protruding corner portion 105 then functions as a positioning stop for engagement with the abutments 111 and 112 associated with the edge rail 107.

To secure the edge rail 107 in the position illustrated by FIG. 25, an elongate screw 113 having a conically tapered head is fed downwardly through a tapered opening (not shown) formed in the top wall 108 of the edge rail, and the screw is then threaded into and through a threaded opening 106 formed in the corner portion 105 so as to effect fixed securement of the edge rail in the position illustrated by FIG. 25, whereby the edge rail creates a nose for enclosing the exposed edge of the floor tiles. The edge rail hence provides an appearance similar to the nose strip which is typically utilized on steps and the like.

While the constructions discussed above relate to a pedestal used in conjunction with a fastener arrangement 93 as illustrated by FIG. 17, which fastener arrangement is believed to possess highly desirable characteristics, it will be appreciated that other fastener arrangements can be provided for securing the floor tiles to the support shelf of the pedestal assembly. Examples of other fasteners are illustrated in FIGS. 26, 27 and 28 as discussed hereinafter.

Figure 26:
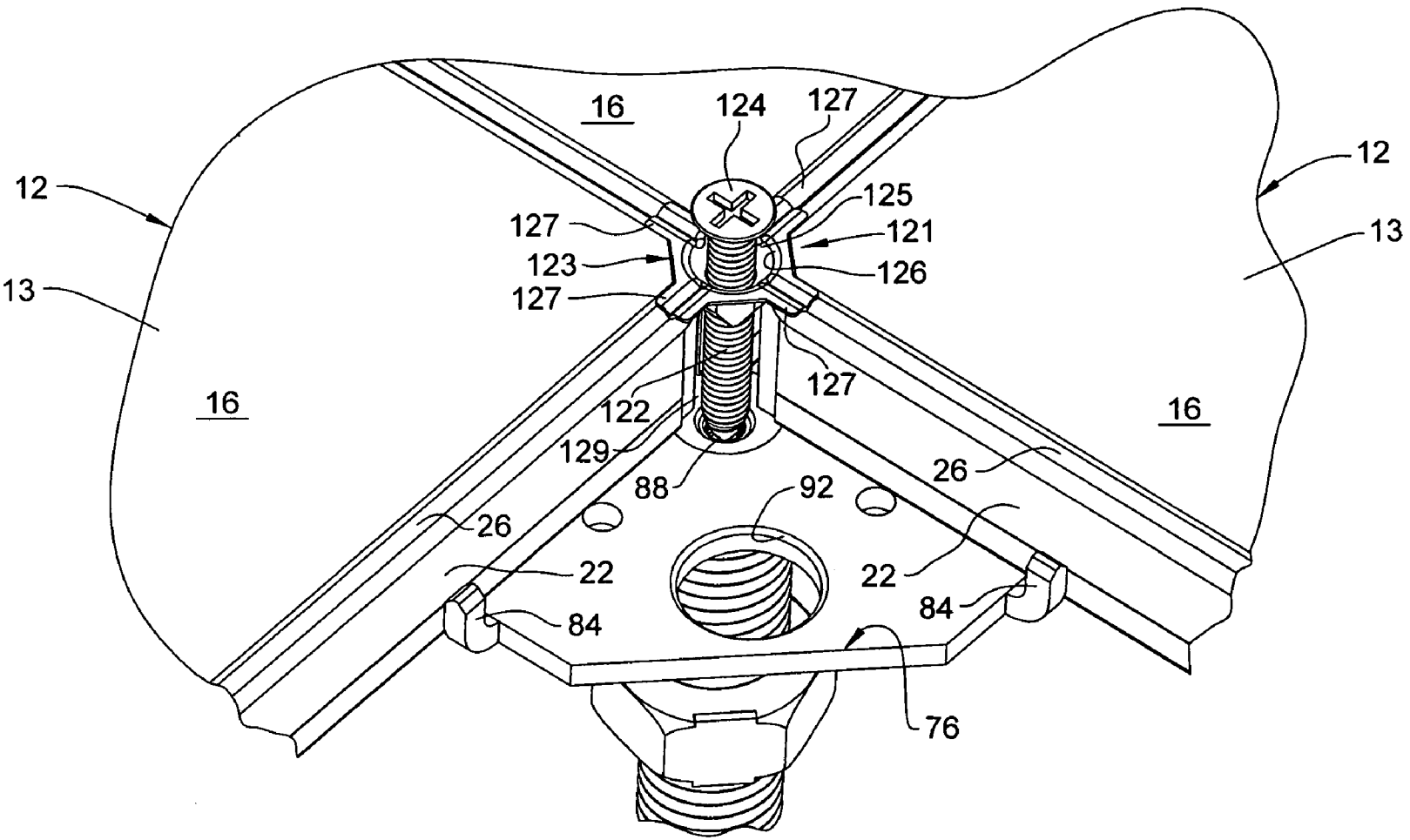
FIG. 26 is a fragmentary perspective view, viewed from above, and illustrating a modification of the fastener which cooperates between the floor tiles and the pedestal head.

Referring initially to FIG. 26, there is illustrated a modified fastener arrangement 121 for securing or holding the floor tiles in engagement with the pedestal shelf. This modified fastener arrangement 121 again includes an elongate screw 122 which at its lower end threads into the threaded center opening 88 of the support shelf, and which has a tapered head for cooperation with a hold down washer 123 which bears against upper surfaces defined on the corner portions of the floor tiles. In this variation, the hold down washer 123 has a center annular portion 125 which defines therein a conical depression 126 for receiving the tapered head 124 of the fastener screw 122. The hold down washer 123 additionally has plural, specifically four, arms 127 which are cantilevered radially outwardly from the center annular portion 125 through a predetermined extent. The arms 127 are uniformly spaced apart at 90 degree intervals so as to define a generally cross-shaped configuration. The arms 127 each have a generally V-shaped cross-section, with the legs of the V being appropriately rounded, so that the arms protrude outwardly a sufficient extent so as to overlie the rounded exterior convex profiles defined by the hems 26 associated with the adjacent side walls of adjacent floor tiles.

Accordingly, when the fastener 122 is threaded into the shelf so as to push downwardly to hold the floor tiles against the shelf, the hold down washer 123 is pushed downwardly causing the V-shaped arms 127 to be pressed against and firmly engage the rounded upper surfaces defined on the hems 126 to positionally secure the floor tiles against the shelf 76. When so assembled, however, the washer and the head of the fastener screw are effectively disposed at an elevation at or slightly below the upper surfaces of the concrete blocks defining the floor tiles, whereby a smooth floor is created, and at the same time the fastener and specifically the hold down washer create an appearance which is not only minimal, but which also effectively closes off the gap or clearance space defined between the corners of the adjacent floor tiles.

Figure 27:
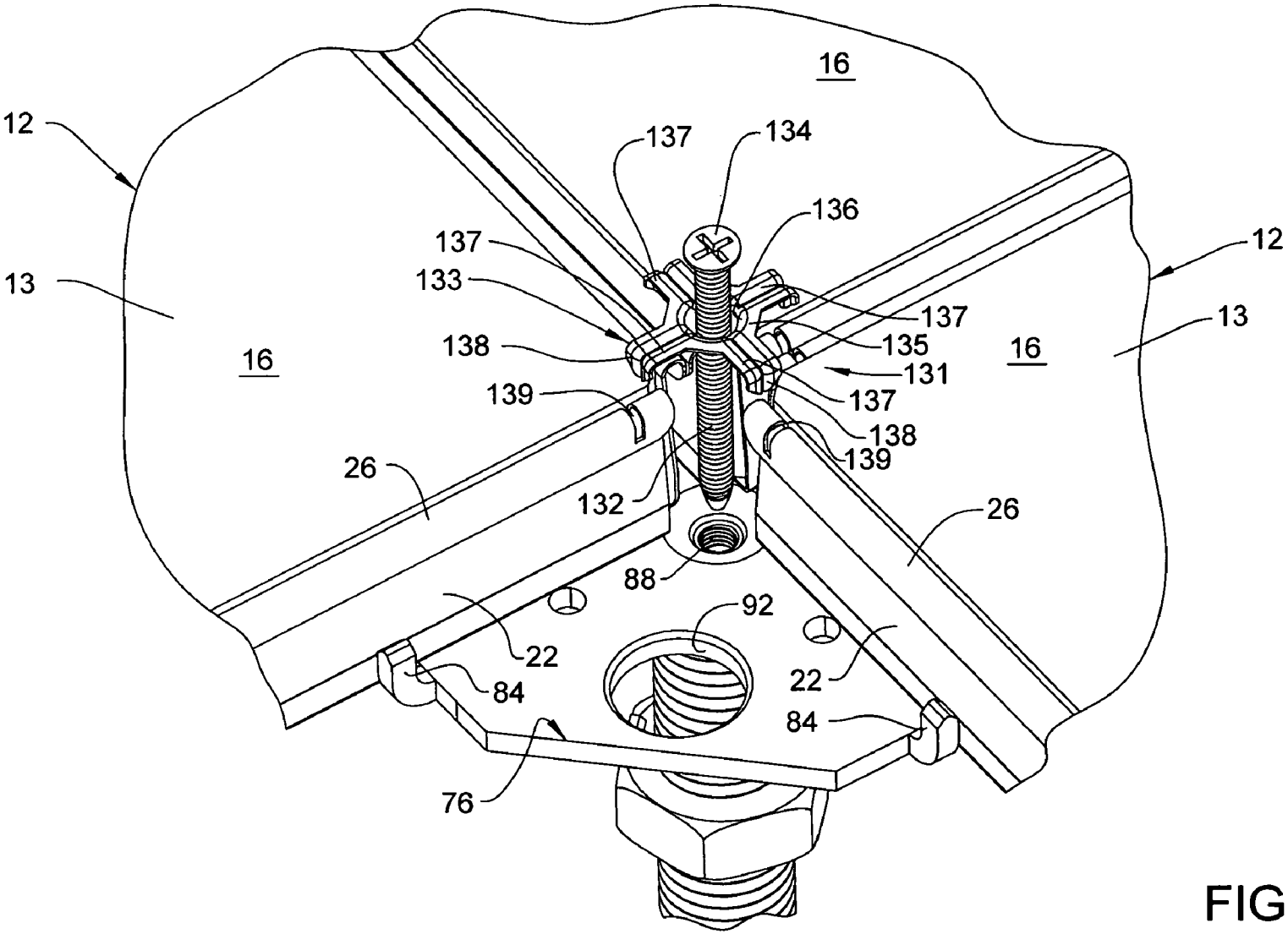
FIG. 27 is a perspective view similar to FIG. 26 and illustrating a further variation of the fastener assembly.
Figure 28:
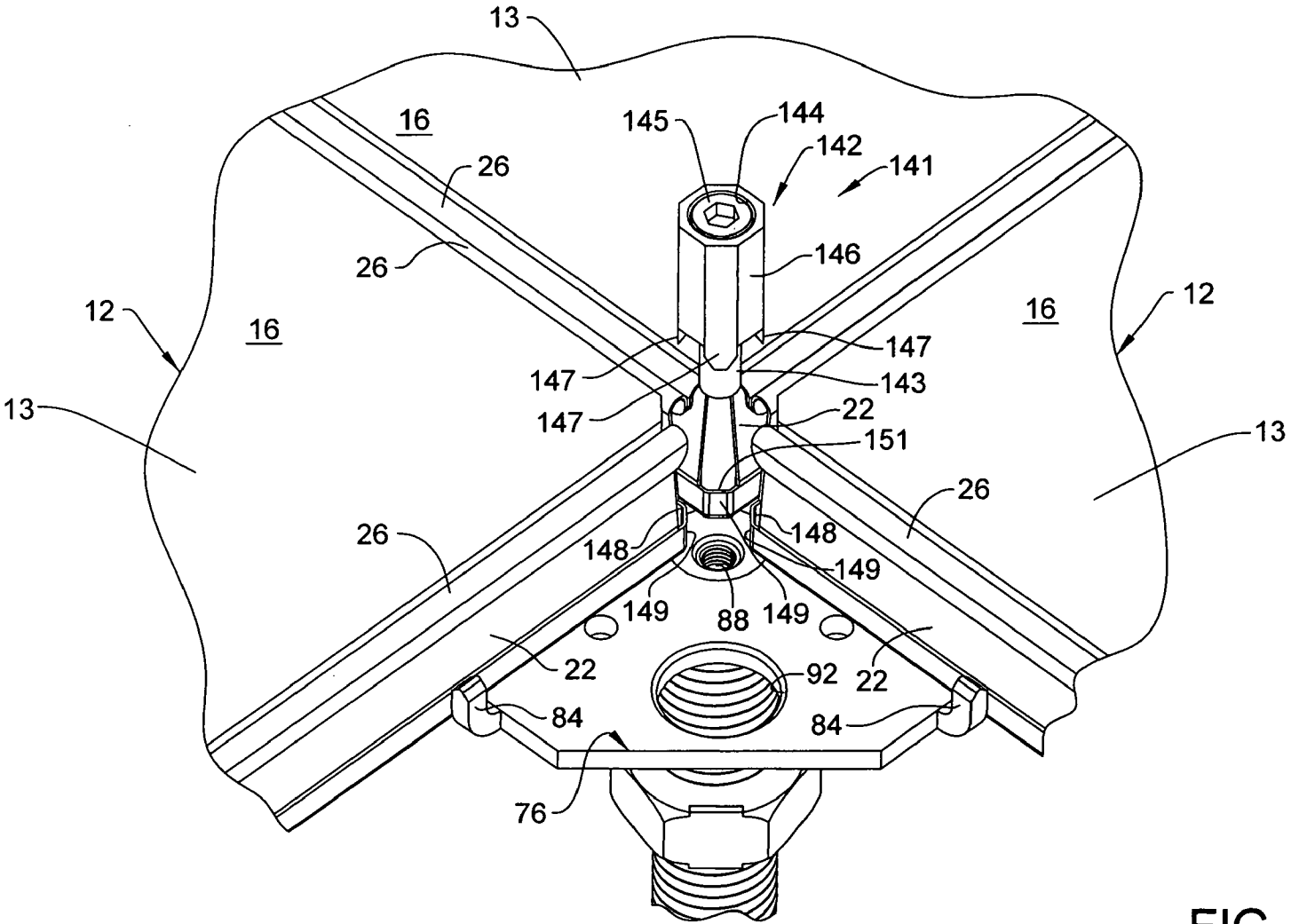
FIG. 28 is a further perspective view similar to FIG. 26 and illustrating still a further variation of the fastener assembly.

FIG. 27 illustrates a modified fastener arrangement 131 which bears significant similarity to the arrangement of FIG. 26 in that the fastener arrangement includes an elongate threaded screw 132 which cooperates with a hold down member 133. As in the prior construction, the fastener has a tapered head 134 which cooperates with a conical depression 126 defined in a center annulus 135, the latter having four elongate arms 137 protruding radially therefrom substantially at 90 degree intervals so as to define a cross shape. The arms 137 are generally V-shaped in cross-section so as to be engagable with upper convex exterior surfaces defined on the hems of the adjacent floor tiles. In addition, however, each of the arms 137 has a downwardly protruding positioning tab 138 formed at the outer free end thereof. The tab 138 is insertable downwardly into a narrow slot 139 formed transversely across and opening upwardly from the rounded upper hem of the floor pan side wall at a location positioned adjacent but spaced inwardly a small distance from the end edge thereof. The securement of the modified fastener 131 is generally similar to the securement of the fastener 121 described above except for the additional function of inserting the tabs 138 into the slots 139 during the assembly process so as to provide an accurate positional orientation or alignment of the various parts.

A further modification of the fastener for securing the floor tiles to the pedestal shelf is illustrated in FIG. 28. The modified fastener arrangement 141 of FIG. 28 includes a vertically elongate hollow hold down sleeve 142 which has a generally octagonal exterior configuration, and which is adapted to have an elongate fastener screw 143 extend therethrough. The hollow sleeve 142 has a counterbore 144 at its upper end which is adapted to accommodate the enlarged cylindrical head 145 of the screw 143. The hold down sleeve 142 at its lower end has a plurality of downwardly-protruding cantilevered tangs 147 associated with alternating sides of the octagonal outer profile, namely there being four such tangs, with each adjacent pair of tangs being separated by a flat side of the outer profile which is free of the tangs. The hollow hold down sleeve 142 is adapted to be inserted into the space defined between the four corners of the four adjacent floor tiles (only three floor tiles being illustrated in FIG. 28 for clarity of illustration), with the downwardly protruding tangs 147 being individually inserted into a space 148 defined behind a bridge part 149 which is integrally joined to and extends between the transverse side walls of the respective floor tile pan. This bridge part 149, as associated with the pan of each floor tile, is located generally at and protrudes upwardly above the bottom wall of the floor tile pan, whereby when the hold down sleeve 142 is inserted into the space between the corners of the floor tiles, the tangs 147 protrude behind the bridge parts 149 of the respective floor tiles so that, when the screw 143 is screwed into the threaded center opening of the shelf 76, the hold down sleeve 142 is pressed downwardly until the bottom edges 151 thereof abut upper edge of the respective bridge parts 149, thereby locking the tangs behind the bridge parts and creating a fixed securement of the floor tiles to the pedestal shelf.

Figure 29:
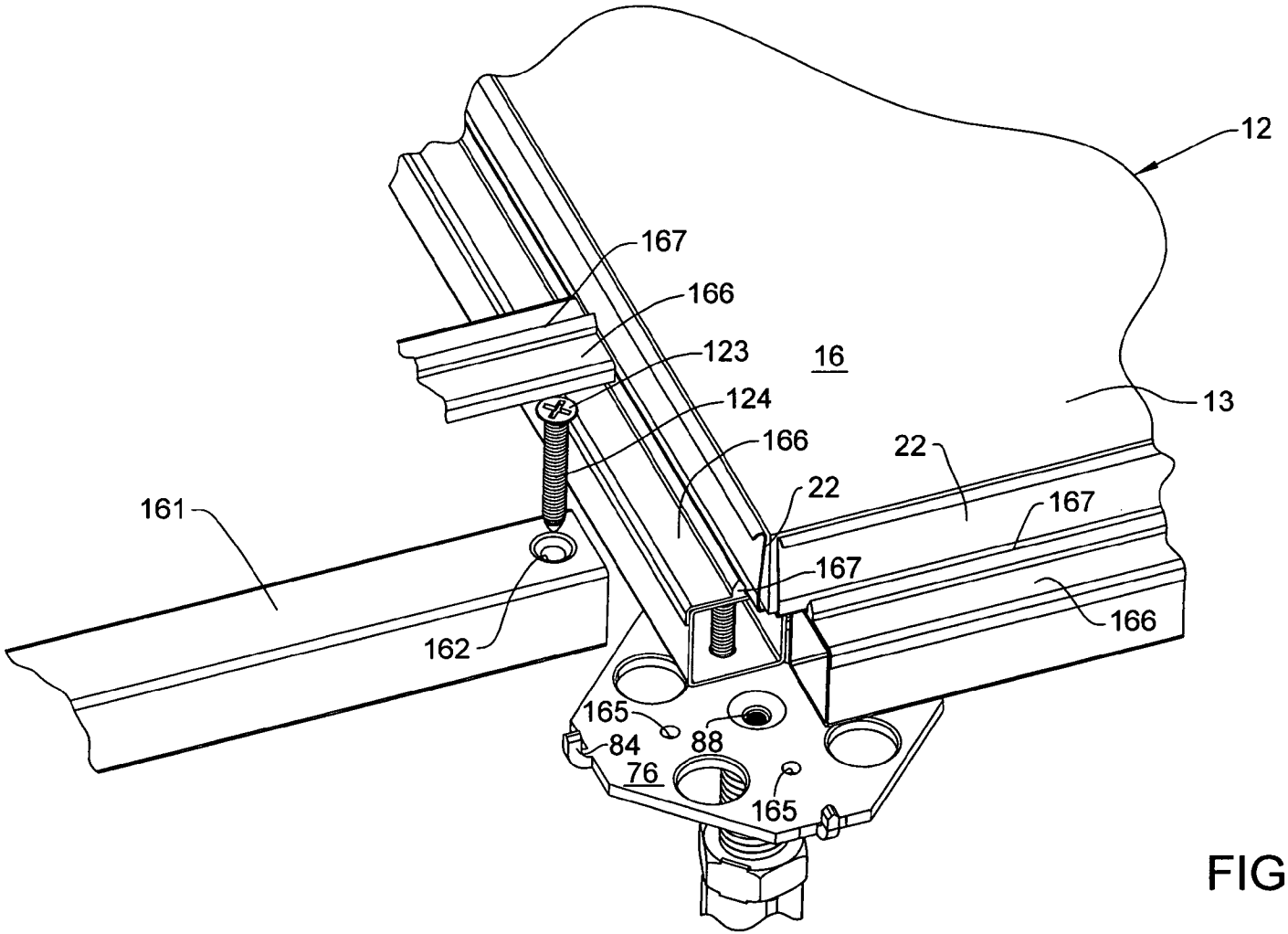
FIG. 29 is a perspective view, taken from above, and illustrating a variation wherein the raised floor system is provided with stringers for cooperation between the raised pedestal head and the floor tiles.
Figure 30:
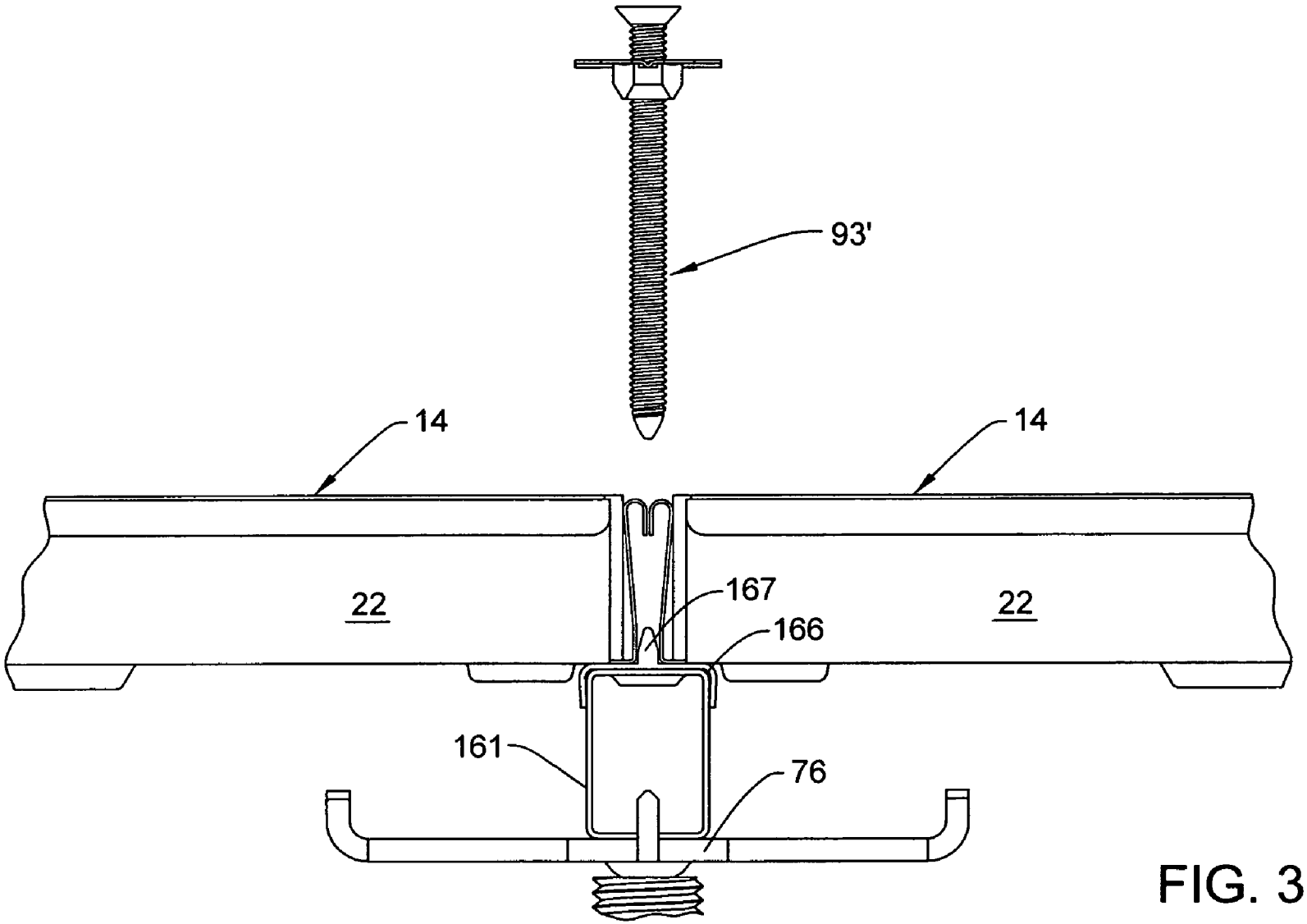
FIG. 30 is a sectional view of the arrangement illustrated by FIG. 29.

While the floor tiles can be supportingly engaged directly on the shelf of the pedestals as described by the embodiments discussed above, the floor tiles 12 can also be supported on elongate stringers which extend between adjacent panels as illustrated in FIGS. 29-30. In this variation, elongate stringers 161, which in the illustrated embodiment comprise elongate hollow tubes of generally square profile, are positioned to extend between the support shelves 76 of adjacent pedestals. The stringers 161 in the illustrated embodiment are adapted to be supported directly on the upper surface of the respective shelf 76, with the stringer rail 161 adjacent the free end thereof having vertically aligned openings 162 extending through the top and bottom walls thereof. The upper one of the openings 162 accommodating the tapered head 163 of a threaded fastener or screw 164 which projects downwardly through the stringer for engagement with one of a plurality of threaded openings 165 formed through the shelf plate 76. The plurality of openings 165 (there being four such openings) are arranged so that each opening is disposed along one of the transverse axes 85-86 generally sidewardly between an adjacent pair of positioning recesses 92. The fastener screw 164 hence effects securement of the stringer 161 to the top surface of the shelf 76. The upper surface of the stringer 161 can be provided with an elongate sealing strip 166 mounted lengthwise therealong. The sealing strip 166, which can be constructed of a suitable plastic or stiff elastomeric material, preferably has a downward channel-shaped cross-section so as to fit snugly onto the upper surface of the stringer 161. This sealing strip 166 has, extending lengthwise generally along the center thereof, an upwardly cantilevered rib 167 which is adapted to protrude into the space or gap between the side walls 22 of adjacent floor tiles 12 to assist in proper positioning of the tiles while also cooperating with the sealing strip to create a seal between the floor tiles 12 and the stringer rails 161.

Figure 31:
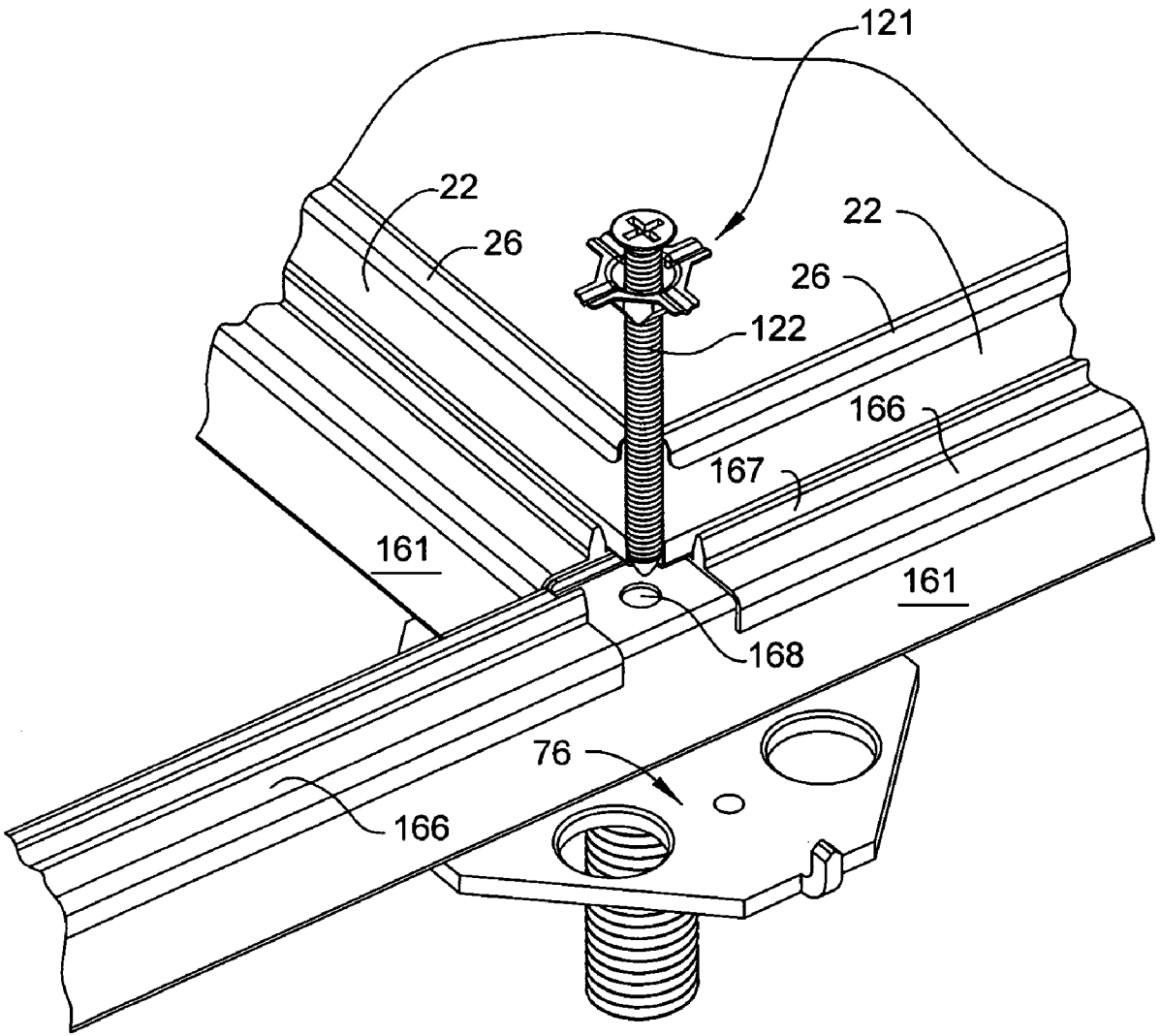
FIG. 31 is a perspective view similar to FIG. 29 but illustrating a modification with respect to the stringer rails which cooperate between the pedestals.

As an alternative to the construction illustrated by FIGS. 29-30, reference is made to FIG. 31 which illustrates replacement of some of the individual aligned stringer rails 161 with a continuous elongate stringer rail 161' which extends between three or more pedestals. This continuous stringer rail 161' again secures to the pedestal shelves in the same manner described relative to FIGS. 29-30. In addition, however, the portion of the continuous stringer rail 161' which spans over the center threaded opening 88 of the shelf 76 is additionally provided with a pair of vertically aligned openings 168 which accommodate a threaded fastener 122 for permitting securement of the floor tiles to the stringer rails. The fastener 121 illustrated in FIG. 31 generally corresponds to the fastener arrangement illustrated in FIG. 17 discussed above except the screw is of longer length.

Figure 32:
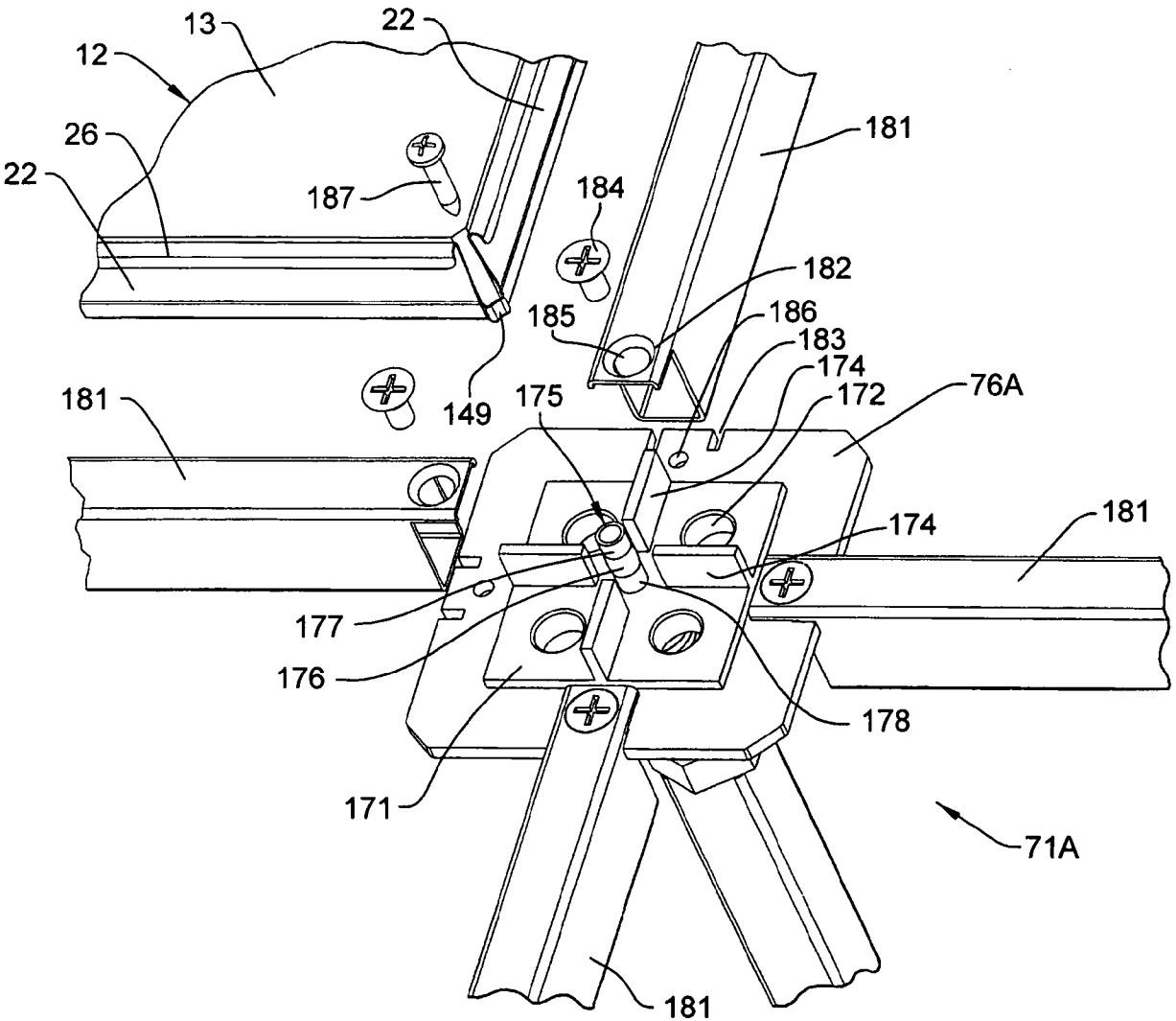
FIG. 32 is an exploded perspective view illustrating further variations with respect to the pedestal construction and the stringers which are optionally connected thereto.
Figure 33:
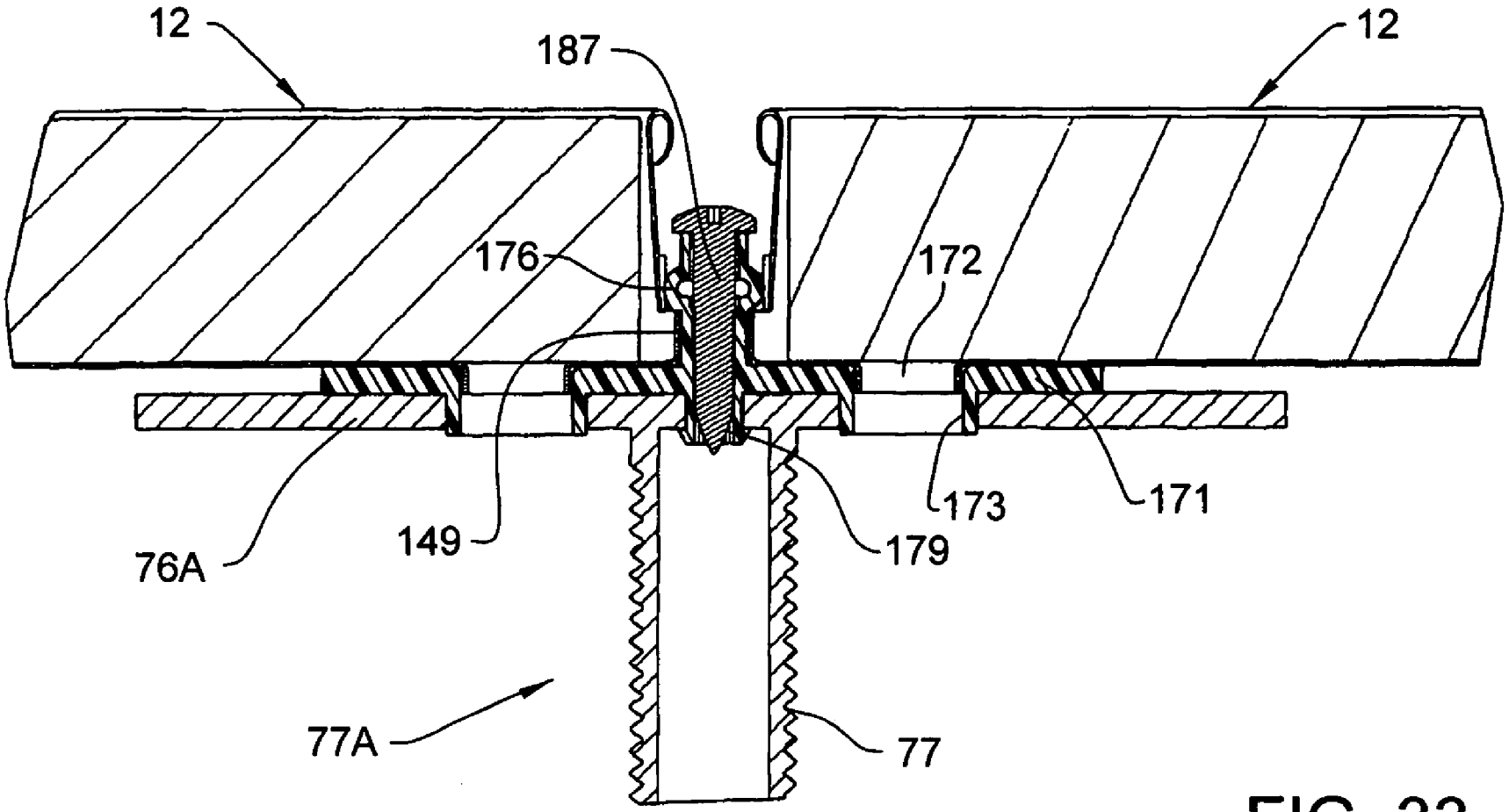
FIG. 33 is a fragmentary sectional view illustrating the securement of the floor tiles to the pedestal arrangement of FIG. 32.

Referring now to FIGS. 32 and 33, there is illustrated further variations of the invention, specifically with respect to the construction of the head or shelf plate provided at the head of the pedestal assembly, and with respect to stringers which extend between and attach to the pedestal head plates.

In this variation, as illustrated by FIG. 32, the shelf or top plate 76A of the pedestal 71A is defined by a generally flat metal plate and is provided with an insert plate 171 disposed on top thereof. The insert plate 171 has positioning or locating openings 172 formed vertically therethrough, the latter being defined by sleeves 173 which project downwardly through similar openings formed in the plate 76A. These positioning openings 173 function in the same manner as the openings 92 associated with the pedestal shelf plate 76 described above.

The insert plate 171 associated with the modified head plate 76A also has spacer plates 174 secured thereto and protruding upwardly in a generally cross-shaped arrangement. The spacer plates 174 function to define sectors for accommodating the corners of the four floor tiles 12 which are supported on the pedestal arrangement, with the individual spacer plates 174 being disposed sidewardly between the sidewardly adjacent floor tiles.

The insert plate 171 also has a fastener receiving sleeve 175 fixed thereto and projecting vertically upwardly therefrom in alignment with the central opening 178 formed in the metal plate 76A. This fastening sleeve 175 includes a deflectable center part 176 defined between upper and lower sleeve parts 177-178. The sleeve 175 permits a threaded fastener 187 to be inserted therethrough for engagement with a lower sleeve part 179 which is snappingly engaged within the metal plate 76 such that, when the fastener 187 is threaded downwardly, the head of the fastener engages the upper end of the sleeve 175 and causes the sleeve to be compressed downwardly, whereby the center part 176 deforms outwardly and overlaps bridge parts 149 formed on the corners of the pans 14 which define the floor tiles to hence permit the floor tiles to be secured against the upper surface of the insert plate substantially as illustrated in FIG. 33.

The modified pedestal head of FIGS. 32-33 can also accommodate elongate stringers or rails 181 which in turn permit supportive engagement with the lower edges of the floor tiles. The stringers 181 in this variation are provided with a protruding mounting part 182 associated with the upper wall and protruding outwardly from the end of the stringer. This protruding mounting part overlaps the plate 76A while at the same time the vertical walls of the stringer protrude into small parallel slots 183 formed through the plate 76A at the respective edge thereof. A fastener screw 184 extends through an opening 185 formed in the protruding part 182 for engagement with a threaded opening 186 formed in the shelf plate 76A to secure the stringer thereto.

The upper surface of the protruding part 182 and the contiguous upper surface of the stringer 181 are substantially co-planar with the upper surface of the insert plate 171 so as to permit the floor tiles to be supportingly engaged therewith.

The pedestal 71A illustrated by FIG. 32 can be utilized either in conjunction with the stringers, or without the stringers by permitting the floor tiles to be supported directly on and secured to the pedestal solely through the cooperative arrangement illustrated in FIG. 33.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In a raised floor arrangement including a plurality of upright pedestals positionable on a subfloor in a grid arrangement wherein the pedestals are disposed within transverse rows and columns, and a plurality of horizontally-oriented floor tiles supported on upper ends of the pedestals to define a generally horizontally oriented upwardly-facing raised floor, the improvement wherein said floor tile comprises:

a generally box-shaped support pan defining therein a shallow upwardly-opening compartment, said support pan having a generally flat bottom wall which at peripheral edges joins to an upright side wall structure, said side wall structure including an upright side wall which extends lengthwise along each side of the bottom wall and protrudes upwardly and terminates at a top edge;

a main one-piece preformed concrete block having a profile in plan view which generally corresponds to the plan view profile of the shallow compartment, said main block having a height which at least substantially equals or slightly exceeds the height of the shallow compartment;

said main preformed block being defined by a predetermined plurality of preformed one-piece concrete sub-blocks each having a thickness corresponding to the thickness of the main concrete block, said sub-blocks being positioned in sidewardly adjacent relationship with opposed edge walls fixedly and rigidly joined in snug abutting contact by an adhesive applied to said contacting edge walls;

said main preformed block being positioned within said compartment and fixedly adhesively adhered to said support pan; and the upright side walls of the pan being preformed to angle inwardly relative to the compartment as they project upwardly to create a resilient engagement with the edge walls of the preformed main concrete block, the side walls being adhesively fixedly secured to the edge walls at the engagement therebetween.

2. A raised floor arrangement according to claim 1, wherein said main concrete block has a bottom surface engaged with and adhesively fixedly secured to the bottom wall of said support pan.

3. A raised floor system according to claim 1, wherein the preformed main concrete block is formed from at least two substantially identical preformed concrete sub-blocks which have a generally rectangular configuration in plan view.

4. A raised floor system according to claim 1, wherein the preformed main concrete block is formed from three substantially identical preformed concrete sub-blocks which have rectangular profiles in plan view and which are all disposed in generally parallel side-by-side relationship and are adhesively fixedly joined at abutting edge walls to define the preformed main concrete block.

5. A raised floor system according to claim 1, wherein corners of the side wall structure of said pan are slit vertically downwardly from said top edges, and wherein said upright side walls are cantilevered upwardly and are angularly deflected into engagement with edge walls of the preformed main concrete block.

6. A raised floor system according to claim 1, wherein the upright side walls of the pan, at the top edges thereof, are provided with a reversely bent edge flange which is positioned exteriorly of the respective side wall and projects downwardly from the respective top edge.

7. A raised floor system according to claim 6, wherein the preformed main concrete block is formed from at least two substantially identical preformed concrete sub-blocks which have a generally rectangular configuration in plan view.

8. In a raised floor arrangement including a plurality of upright pedestals positionable on a subfloor in a grid arrangement wherein the pedestals are disposed within transverse rows and columns, and a plurality of horizontally-oriented floor tiles supported on upper ends of the pedestals to define a generally horizontally oriented upwardly-facing raised floor, the improvement wherein said floor tile comprises:

a generally box-shaped support pan defining therein a shallow upwardly-opening compartment, said support pan having a generally flat bottom wall which at peripheral edges joins to an upright side wall structure, said side wall structure including an upright side wall which extends lengthwise along each side of the bottom wall and protrudes upwardly and terminates at a top edge;

a main one-piece preformed concrete block having a profile in plan view which generally corresponds to the plan view profile of the shallow compartment, said main block having a height which at least substantially equals or slightly exceeds the height of the shallow compartment;

wherein corners of the side wall structure of said pan are slit vertically downwardly from said top edges, and wherein said upright side walls are cantilevered upwardly and are angularly deflected into engagement with edge walls of the main preformed concrete block;

said main preformed block being positioned within said compartment and fixedly adhered to said support pan, said main concrete block having a bottom surface engaged with and adhesively fixedly secured to the bottom wall of said support pan, said main concrete block also having edge walls thereof engaged with inner surfaces of said support pan side walls; and the upright side walls of the pan being preformed to angle inwardly relative to the compartment as they project upwardly to create a resilient engagement with the edge walls of the main preformed concrete block, and the side walls being adhesively fixedly secured to the edge walls at the engagement therebetween.

9. A raised floor system according to claim 8, wherein the upright side walls of the pan, at the top edges thereof, are provided with a reversely bent edge flange which is positioned exteriorly of the respective side wall and projects downwardly from the respective top edge.

10. In a raised floor arrangement including a plurality of upright pedestals positionable on a subfloor in a grid arrangement wherein the pedestals are disposed within transverse rows and columns, and a plurality of horizontally-oriented floor tiles supported on upper ends of the pedestals to define a generally horizontally oriented upwardly-facing raised floor, the improvement wherein said floor tile comprises:

a generally box-shaped support pan defining therein a shallow upwardly-opening compartment, said support pan having a generally flat bottom wall which at peripheral edges joins to an upright side wall structure, said side wall structure including an upright side wall which extends lengthwise along each side of the bottom wall and protrudes upwardly and terminates at a top edge;

a main one-piece preformed concrete block having a profile in plan view which generally corresponds to the plan view profile of the shallow compartment, said main block having a height which at least substantially equals or slightly exceeds the height of the shallow compartment;

said main one-piece preformed concrete block being positioned within said compartment and fixedly adhered to said support pan, said main concrete block having a bottom surface engaged with and adhesively fixedly secured to the bottom wall of said support pan; and the upright side walls of the pan being preformed so that at least upper portions of the side walls protrude inwardly and create a resilient engagement with the edge walls of the main preformed concrete block when the main concrete block is positioned within the compartment, the side walls being adhesively fixedly secured to the edge walls at the engagement therebetween.

11. A raised floor system according to claim 10, wherein the upright side walls of the pan, at the top edges thereof, are provided with a reversely bent edge flange which is positioned exteriorly of the respective side wall and projects downwardly from the respective top edge to define a downwardly directed groove to permit gripping and outward deflecting of the side wall to facilitate positioning of the concrete block within the compartment.

12. A raised floor system according to claim 10, wherein corners of the side wall structure of said pan are slit vertically downwardly from said top edges, and wherein said upright side walls are cantilevered upwardly and are angularly deflected into engagement with edge walls of the main preformed concrete block.

13. In a raised floor arrangement including a plurality of upright pedestals positionable on a subfloor in a grid arrangement wherein the pedestals are disposed within transverse rows and columns, and a plurality of horizontally-oriented floor tiles supported on upper ends of the pedestals to define a generally horizontally oriented upwardly-facing raised floor, the improvement wherein said floor tile comprises:

a generally box-shaped support pan preformed from thin metal sheet and defining therein a shallow upwardly-opening compartment, said support pan having a generally flat bottom wall which at peripheral edges joins to an upright side wall structure, said side wall structure including an upright side wall which extends lengthwise along each side of the bottom wall and protrudes upwardly and terminates at a top edge, the bottom and side walls of the pan being free of protrusions or the like which project into said compartment;

a main one-piece preformed concrete block having a profile in plan view which generally corresponds to the plan view profile of the shallow compartment, said main one-piece preformed concrete block having a height which at least substantially equals or slightly exceeds the height of the shallow compartment;

said main one-piece preformed concrete block being formed by a predetermined plurality of preformed one-piece rigid concrete sub-blocks each having a thickness corresponding to the thickness of the main concrete block, said predetermined plurality of concrete sub-blocks being positioned in sidewardly adjacent relationship with opposed edge walls which are surface-finished to provide surface uniformity and flatness, the opposed surface-finished edge walls being fixedly and rigidly joined in snug abutting contact by an adhesive applied to said contacting edge walls so as to create said main one-piece preformed concrete block prior to its disposition into the pan; and said main one-piece preformed concrete block being positioned within said compartment and fixedly adhesively adhered to said support pan, said main one-piece concrete block having a bottom surface engaged with and adhesively fixedly secured to the bottom wall of said support pan, and having edge walls engaged and adhesively fixedly adhered to inner surfaces of said support pan side walls.

14. A raised floor system according to claim 13, wherein the preformed one-piece main concrete block is entirely formed by a predetermined plurality of substantially identical preformed concrete sub-blocks which have a generally rectangular configuration in plan view.

15. A raised floor system according to claim 14, wherein the preformed main concrete block is formed from three substantially identical preformed concrete sub-blocks which have rectangular profiles in plan view and which are all disposed in generally parallel side-by-side relationship and are adhesively fixedly joined at abutting surface-finished edge walls to define the preformed main concrete block.

16. A raised floor system according to claim 13, wherein said upright side walls are cantilevered upwardly and are resiliently deflected for engagement with edge walls of the main one-piece preformed concrete block, and wherein the side walls are adhesively fixedly secured to the edge walls at the engagement therebetween.

17. A raised floor system according to claim 13, wherein the main one-piece preformed concrete block has an upward-facing top surface which is surface finished to provide a smooth flat surface to function as the exposed top surface of the floor tile.

* * * * *